US010370136B1

(12) United States Patent
Linnell et al.

(10) Patent No.: US 10,370,136 B1
(45) Date of Patent: Aug. 6, 2019

(54) ON-DEMAND PROTECTIVE STRUCTURES FOR PACKAGING ITEMS IN A CONTAINER

(71) Applicant: X Development LLC, Mountain View, CA (US)

(72) Inventors: Jeff Linnell, Woodside, CA (US); Matthew Bitterman, Mountain View, CA (US); Tobias Kinnebrew, Mountain View, CA (US)

(73) Assignee: X Development LLC, Mountain View, CA (US)

( * ) Notice: Subject to any disclaimer, the term of this patent is extended or adjusted under 35 U.S.C. 154(b) by 79 days.

(21) Appl. No.: 15/810,586

(22) Filed: Nov. 13, 2017

Related U.S. Application Data

(63) Continuation of application No. 14/574,324, filed on Dec. 17, 2014, now Pat. No. 9,828,128.

(51) Int. Cl.
*G06F 7/00* (2006.01)
*B65B 59/02* (2006.01)
(Continued)

(52) U.S. Cl.
CPC ..... *B65B 59/02* (2013.01); *B65B 35/10* (2013.01); *B65B 55/00* (2013.01)

(58) Field of Classification Search
None
See application file for complete search history.

(56) References Cited

U.S. PATENT DOCUMENTS 2,579,036 A 12/1951 Edelman
3,913,731 A * 10/1975 Purdom ..... B65B 25/146 198/394
(Continued)

FOREIGN PATENT DOCUMENTS

CN 103640793 3/2014
CN 203558300 4/2014
(Continued)

OTHER PUBLICATIONS

Guo et al. "Shock Absorbing Characteristices and Vibration Transmissibility of Honeycomb Paperboard," IOS Press, Shock and Vibration 11, pp. 521-531.

*Primary Examiner* — Yolanda R Cumbess
(74) *Attorney, Agent, or Firm* — Fish & Richardson P.C.

(57) ABSTRACT

Example methods and systems are disclosed for on-demand packaging of one or more items. According to one example, a method can include receiving an order for the item(s) and determining characteristic-information for the item(s) using a computer system. The characteristic-information includes an indication of at least a size and a shape of the item(s). The method also includes processing the characteristic-information based on design criteria to determine an arrangement of the item(s) within at least one container volume, and a configuration for a protective structure to hold the item(s) in the arrangement within the container volume(s). The method can further include, in response to the processing the characteristic-information, forming the protective structure according to the configuration, placing the item(s) into the protective structure according to the arrangement, and placing the protective structure and the item(s) in the container volume(s).

20 Claims, 9 Drawing Sheets

(51) Int. Cl.
*B65B 55/00* (2006.01)
*B65B 35/10* (2006.01)

(56) References Cited

U.S. PATENT DOCUMENTS

| | | | |
|---|---|---|---|
| 4,852,743 | A | 8/1989 | Ridgeway |
| 5,196,150 | A | 3/1993 | Mimura et al. |
| 5,236,507 | A | 8/1993 | Brown |
| 5,267,652 | A | 12/1993 | Carroll |
| 5,636,744 | A | 6/1997 | Hirose |
| 5,765,688 | A | 6/1998 | Bertram et al. |
| 6,092,651 | A | 7/2000 | Miller |
| 6,116,423 | A | 9/2000 | Troxtell, Jr. et al. |
| 6,158,589 | A | 12/2000 | Smith et al. |
| 6,200,245 | B1 | 3/2001 | Dodo et al. |
| 6,721,762 | B1 | 4/2004 | Levine et al. |
| 6,896,142 | B2 | 5/2005 | Kaltz, Jr. et al. |
| 7,086,327 | B2 | 8/2006 | Furamura et al. |
| 7,106,528 | B2 | 9/2006 | Ohmori et al. |
| 7,298,385 | B2 | 11/2007 | Kazi et al. |
| 7,364,042 | B2 | 4/2008 | Weder |
| 7,588,148 | B2 | 9/2009 | Yang |
| 7,647,752 | B2 | 1/2010 | Magnell |
| 7,662,468 | B2 | 2/2010 | Bainbridge |
| 7,731,033 | B2 | 6/2010 | Sattora et al. |
| 7,739,894 | B2 | 6/2010 | Suzuki |
| 7,814,733 | B2 | 10/2010 | Carlson et al. |
| 8,155,775 | B2 | 4/2012 | Barchelder |
| 8,234,844 | B2 | 8/2012 | Davlin et al. |
| 8,340,812 | B1 | 12/2012 | Tian et al. |
| 8,560,461 | B1 | 10/2013 | Tian et al. |
| 8,639,472 | B2 | 1/2014 | Barlow et al. |
| 8,683,777 | B2 | 4/2014 | Armington et al. |
| 8,720,691 | B2 | 5/2014 | Hu |
| 8,726,802 | B2 | 5/2014 | Senda et al. |
| 8,777,008 | B2 | 7/2014 | Hu |
| 9,128,611 | B2 | 9/2015 | Gray |
| 9,248,611 | B2 | 2/2016 | Divine et al. |
| 10,026,044 | B1 * | 7/2018 | Wurman ..... G06Q 10/047 |
| 2001/0017023 | A1 * | 8/2001 | Armington ..... B31D 5/0047 53/472 |
| 2002/0002811 | A1 | 1/2002 | Weder et al. |
| 2003/0200111 | A1 * | 10/2003 | Damji ..... G06Q 10/08 705/335 |
| 2004/0262187 | A1 | 12/2004 | Schauer |
| 2005/0139509 | A1 | 6/2005 | Bussey, Jr. et al. |
| 2006/0127648 | A1 | 6/2006 | De Luca |
| 2010/0064907 | A1 | 3/2010 | Niizuma |
| 2011/0186474 | A1 | 8/2011 | Weder |
| 2011/0197550 | A1 | 8/2011 | Carlson et al. |
| 2011/0308204 | A1 * | 12/2011 | Corradi ..... B65B 55/20 53/472 |
| 2012/0090482 | A1 | 4/2012 | Kohno et al. |
| 2013/0152511 | A1 | 6/2013 | Derby |
| 2013/0247519 | A1 | 9/2013 | Clark et al. |
| 2013/0291614 | A1 | 11/2013 | Ichijo et al. |
| 2014/0067104 | A1 * | 3/2014 | Osterhout ..... G06Q 50/28 700/97 |
| 2014/0069163 | A1 | 3/2014 | Nojiri et al. |
| 2014/0208964 | A1 | 7/2014 | Kohno et al. |
| 2015/0145158 | A1 | 5/2015 | Levine et al. |

FOREIGN PATENT DOCUMENTS

| | | |
|---|---|---|
| DE | 102011055455 | 5/2013 |
| EP | 0250389 A1 | 6/1987 |
| GB | 2472434 | 9/2011 |
| KR | 2010-0075150 | 7/2010 |
| WO | WO 2007/015681 | 2/2007 |
| WO | WO 2013/144036 | 10/2013 |

* cited by examiner

ON-DEMAND PROTECTIVE STRUCTURES FOR PACKAGING ITEMS IN A CONTAINER

CROSS-REFERENCE TO RELATED APPLICATION

This application is a continuation of U.S. application Ser. No. 14/574,324, filed Dec. 17, 2014, the contents of which are incorporated by reference herein.

BACKGROUND

Unless otherwise indicated herein, the materials described in this section are not prior art to the claims in this application and are not admitted to be prior art by inclusion in this section.

Order fulfillment generally involves receiving, processing, and shipping orders for goods to purchasers or other recipients. Orders may be business-to-business orders or direct-to-consumer orders, among other possibilities. When an order is received, the goods are retrieved from a point of storage, e.g., a warehouse, for packaging. A container is selected, the goods are placed in the container, and the container is filled with cushioning material to protect the goods during shipment. Common types of cushioning material include air cushions (e.g., seal plastic bags filled with air), bubble wrap, paper cushioning (e.g., crumpled paper), cellulose wadding, and foam packing peanuts.

Conventional approaches to packaging goods for an order are inefficient and often ineffective. In particular, a conventional packaging process typically requires excessive and wasteful amounts of cushioning material. In addition, to provide the desired amount of cushioning, many conventional approaches require large volumes of cushioning material and a larger container, thereby increasing the amount of cost and effort to handle and ship the container. Moreover, even if the space in a container is filled with cushioning material, the cushioning material may not prevent the goods from shifting in the container and becoming damaged during shipment. Indeed, the packaging process itself may result in damaging the goods. For example, filling the remaining space in a container with packing peanuts after goods have been placed in the container may apply forces that may damage the goods.

SUMMARY

According to aspects of the present disclosure, an on-demand packaging system is disclosed to provide rapid creation of a packaging that is custom designed based on the specific items in an order. When the order is received, the order is analyzed to determine characteristic information about the items to be packed such as, e.g., value, shape, size, weight, center of mass, shear strength, hardness/softness, solid/liquid, material composition, and other properties. The characteristic information is then used to determine a custom packaging specification including a type of container, an arrangement for positioning the items in the container, and/or a configuration of a protective structure for retaining and protecting the items according to the arrangement in the container. In some aspects, the custom packaging specification can be determined or optimized based on packaging efficiency, cost, protection, package handling, and/or aesthetic considerations. Once the packaging specification is determined, a custom protective structure is rapidly manufactured on-demand. The dynamic nature of the system allows the protective structure to be custom tailored to the specific items ordered and, thus, the system can form a variety of different protective structure configurations for different orders including different combinations of items.

According to one embodiment of the present invention, a method for on-demand packaging of one or more items includes receiving, by a computing system, an order for one or more items and determining, by the computing system, characteristic-information for the one or more items. The characteristic-information includes at least a size indication and a shape indication for each of the one or more items. The method also includes processing, by the computing system, the characteristic-information based on one or more design criteria and, based on the processing of the characteristic-information, determining an arrangement of the one or more items within at least one container volume. The determined arrangement includes a respective position and a respective orientation of each item relative to the at least one container volume. The method further includes determining, by the computing device, a configuration of a protective structure to hold the one or more items in the determined arrangement within the at least one container volume. The determined configuration of the protective structure includes at least two portions that are couplable to form the protective structure. The method still further includes operating at least one automated packaging manufacturing system to form the at least two portions of the protective structure according to the determined configuration, operating at least one of one or more robotic devices to place the one or more items into the protective structure according to the determined arrangement, and operating at least one the one or more robotic devices to place the protective structure, and the one or more items into the at least one container volume.

According to another embodiment of the present invention, a system for order fulfillment includes at least one automated packaging manufacturing system configured to form a plurality of different protective structures. The system also includes at least one controller in operative communication with the at least one automated packaging manufacturing system and at least one memory device storing instructions that, when executed by the at least one controller, cause the system to receive an order for one or more items and determine characteristic-information for the one or more items. The characteristic-information includes at least a size indication and a shape indication for each of the one or more items. The instructions further cause the system to process the characteristic-information based on one or more design criteria and, based on the processing of the characteristic-information, determine an arrangement of the one or more items within at least one container volume. The determined arrangement includes a respective position and a respective orientation of each item relative to the at least one container volume. The instructions still further cause the system to determine a configuration of a protective structure to hold the one or more items in the determined arrangement within the at least one container volume. The determined configuration of the protective structure includes at least two portions that are couplable to form the protective structure. The instructions also cause the system to operate the at least one automated packaging manufacturing system to form the at least two portions of the protective structure according to the determined configuration.

These as well as other aspects, advantages, and alternatives, will become apparent to those of ordinary skill in the art by reading the following detailed description, with reference where appropriate to the accompanying drawings.

Figure 1:
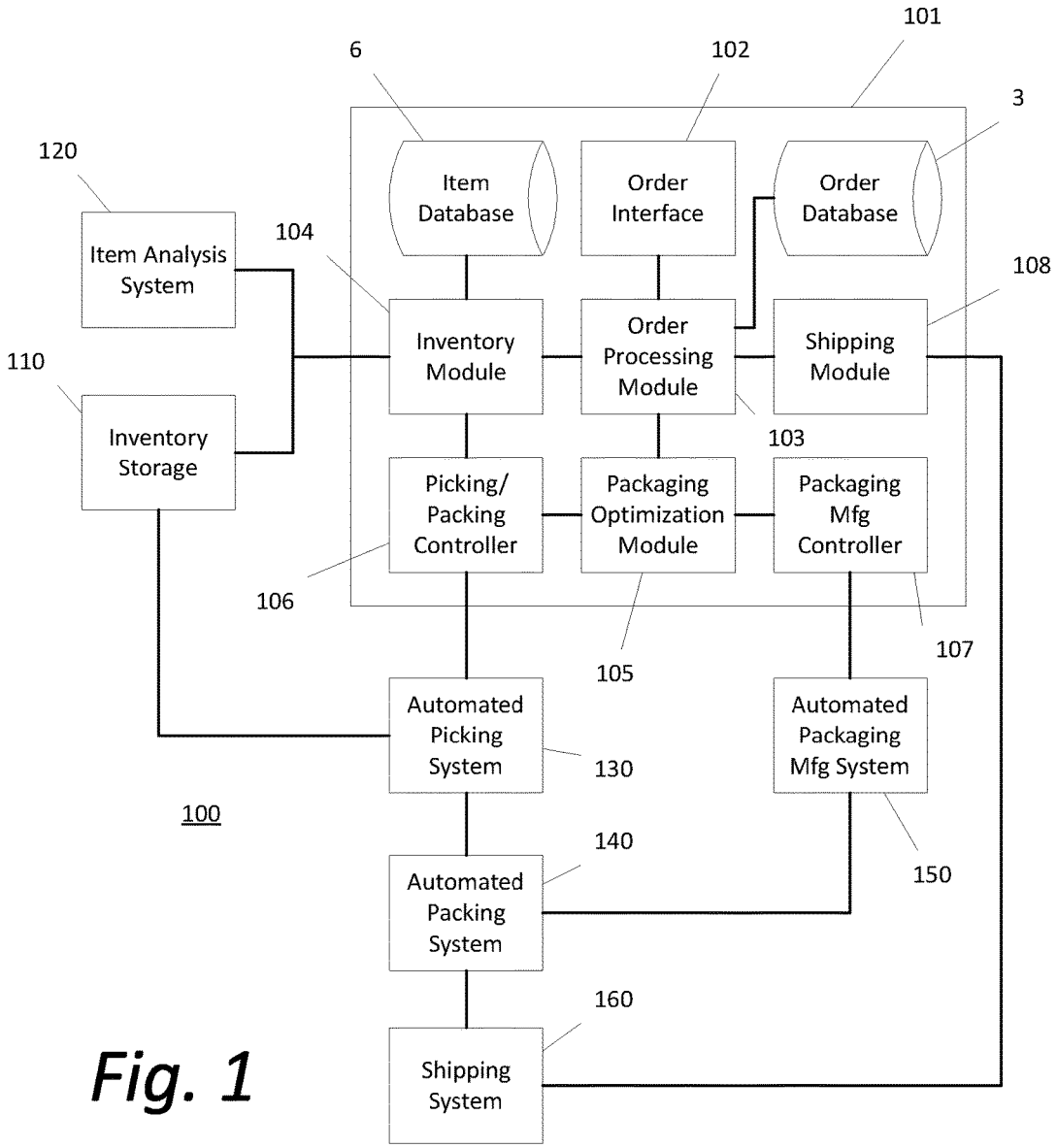
FIG. 1 illustrates an example order system for processing an order for one or more items, according to aspects of the present disclosure.

While the invention is susceptible to various modifications and alternative forms, specific embodiments have been shown by way of example in the Figures and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims. It should be understood that other embodiments may include more or less of each element shown in a given Figure. Further, some of the illustrated elements may be combined or omitted. Yet further, an example embodiment may include elements that are not illustrated in the Figures.

DETAILED DESCRIPTION

The following detailed description describes various features and functions of the disclosed systems and methods with reference to the accompanying figures. In the Figures, similar symbols typically identify similar components, unless context dictates otherwise. The illustrative system and method embodiments described herein are not meant to be limiting. It will be readily understood that certain aspects of the disclosed systems and methods can be arranged and combined in a wide variety of different configurations, all of which are contemplated herein.

I. Overview

Aspects of an order processing system employ an automated packaging manufacturing system for rapid on-demand creation of customized protective structures. These customized protective structures are configured to arrange and protect specific (e.g., unique) combinations of items packed inside a container (e.g., box, crate, etc.). The automated packaging manufacturing system, for example, may be employed by an order processing system in a retail shipping/distribution facility.

When an order is received, the order processing system analyzes the order to identify the items in the order and to determine any number of characteristics about each item, including, but not limited to, shape, size, weight, center of mass, shear strength, bending strength, compression strength, hardness/softness, solid/liquid, material composition, fragility, value, and special handling/packing instructions. Evaluating these characteristics, the order processing system determines a more optimal way to package the items, including, but not limited to: (i) what type of containers to use; (ii) how many of each container type to use; (iii) what items to place in each container; (iv) how the items should be arranged and oriented in each container relative to each other and to the container; and (iv) how a protective structure for each container should be formed to meet the specifications of the arrangement. In addition, the protective structure for each container may be designed in an effort to employ a reduced (and potentially minimal) amount of material and to reduce (and potentially minimize) the volume of the container.

Once the more optimal arrangement of the items in each container is determined, the automated packaging manufacturing system makes one or more custom protective structures for receiving and positioning the items in the container according to the planned arrangement. The protective structures can be formed with specific shapes and sizes according to the planned arrangement. The protective structures may include one or more positioning/retaining features that engage the items and hold them securely in position inside the three-dimensional space of the container. For example, the positioning/retaining features may include recesses and/or cavities that are shaped to receive the items. In addition, the protective structures can be shaped to accommodate the interior shape of the container. In general, the protective structures provide sufficient support so that the items can maintain their positions in the container according to the planned arrangement, while also absorbing any forces that may otherwise damage the items.

After an order is received, rapid manufacturing of the one or more protective structures may occur while other aspects of the order processing occur simultaneously (e.g., while the items are being retrieved from inventory storage and assembled at a packing location). The one or more protective structures are formed after the order is analyzed to optimize packaging and is ready when the items have been assembled for packing. The dynamic nature of the order processing system allows optimized packaging of different orders, which may include any combination and number of different items. As such, the order processing system can advantageously handle large volumes of mixed-SKU orders.

In one non-limiting example, a first order includes two coffee mugs and a second order includes four glasses. The same order processing system can dynamically determine a unique packaging configuration for each order where, for example, a first protective structure has two internal cavities shaped to receive the two coffee mugs and a second protective structure has four internal cavities shaped to receive the four glasses. Additionally, for example, the system may determine that the glasses are more fragile than the coffee mugs, so the second protective structure may utilize more material to provide extra protection as compared to the first protective structure. Because the order processing system dynamically determines the specifications for the packaging scheme after the order is received, the packaging scheme can be optimized for the particular combination of items that is specified in the order. For example, the packaging scheme can optimize the arrangement (i.e., positioning and orientation) of the items relative to each other.

Order processing systems according to the present disclosure have advantages over other systems that use a generic packing material (e.g., packing peanuts) to fill unused space in the container but fail to keep the items securely in position for an optimal arrangement. Custom protective structures according to the present disclosure can also be optimized to minimize the amount of packaging material used in the container. The disclosed order processing systems also have advantages over systems that use the actual items to shape packaging material. For example, other order processing systems may provide shaped packaging materials by spraying or otherwise applying material (e.g., a foam) directly to the items once they are placed in the container, posing the risk of breaking or damaging the items.

Aspects of the order processing system according to the present disclosure can be partially or wholly implemented under automatic computer/machine control. For example, one or more computers and/or machines (e.g., robotic devices) can be employed to receive an order, determine a more optimal way to package the items, determine optimal configuration(s) for protective structure(s), manufacture the protective structure(s), and pack the items with the protective structure(s) in the container(s).

II. Example System and Method

FIG. 1 illustrates an example order system 100 for processing an order for one or more items. Aspects of the order system 100 employ an automated system for manufacturing protective structures that are used to arrange the items in one or more containers and to protect the items during shipment. In some cases, a business may implement the order system 100 to ship items to outside customers, which may include consumers and/or other businesses. Additionally or alternatively, the order system 100 may be implemented to send items internally between departments, divisions, subsidiaries, etc., within the same business. In general, however, an order refers to any type of request that results in the movement of one or more items between two locations, regardless of the entity or entities involved with the request.

In some cases, a business may produce some or all of the items in an order. Additionally or alternatively, the business may obtain some or all of the items in an order from another source. In general, the items in an order may include any number and combination of physical objects having different characteristics. With on-demand manufacturing of customized packaging, the order system 100 can provide protective structures for the particular combination of items in an order, regardless of the number of items and the varying characteristics of the items. Moreover, as described further below, the order system 100 determines a customized packaging scheme that can maximize protection for the items while also satisfying other requirements for the packaging.

The order system 100 includes a computing system 101 that manages aspects of the order processing. The computing system 101 includes an order interface 102 through which orders can be received for processing. The order interface 102 may be communicatively coupled to an order entry system (not shown) that receives orders. In some cases, sales personnel may enter orders from customers into the order entry system. Additionally or alternatively, outside customers may enter some or all orders directly into the order entry system. The order entry system, for example, may include order entry screens on a website and/or a software application provided by a business. The order entry screens may be accessible via any personal computing device such as, for example, a mobile phone, a laptop computer, a desktop computer, a tablet computer, etc.

The order system 100 includes various modules that can process the information in the orders received through the order interface 102. In addition, the order system 100 includes various controllers that can control aspects of physical systems that manufacture the customized packaging for each order and that pick, pack, and ship items for each order. Aspects of these modules and controllers can be described with additional reference to the flowchart illustrated in FIG. 2.

Figure 2:
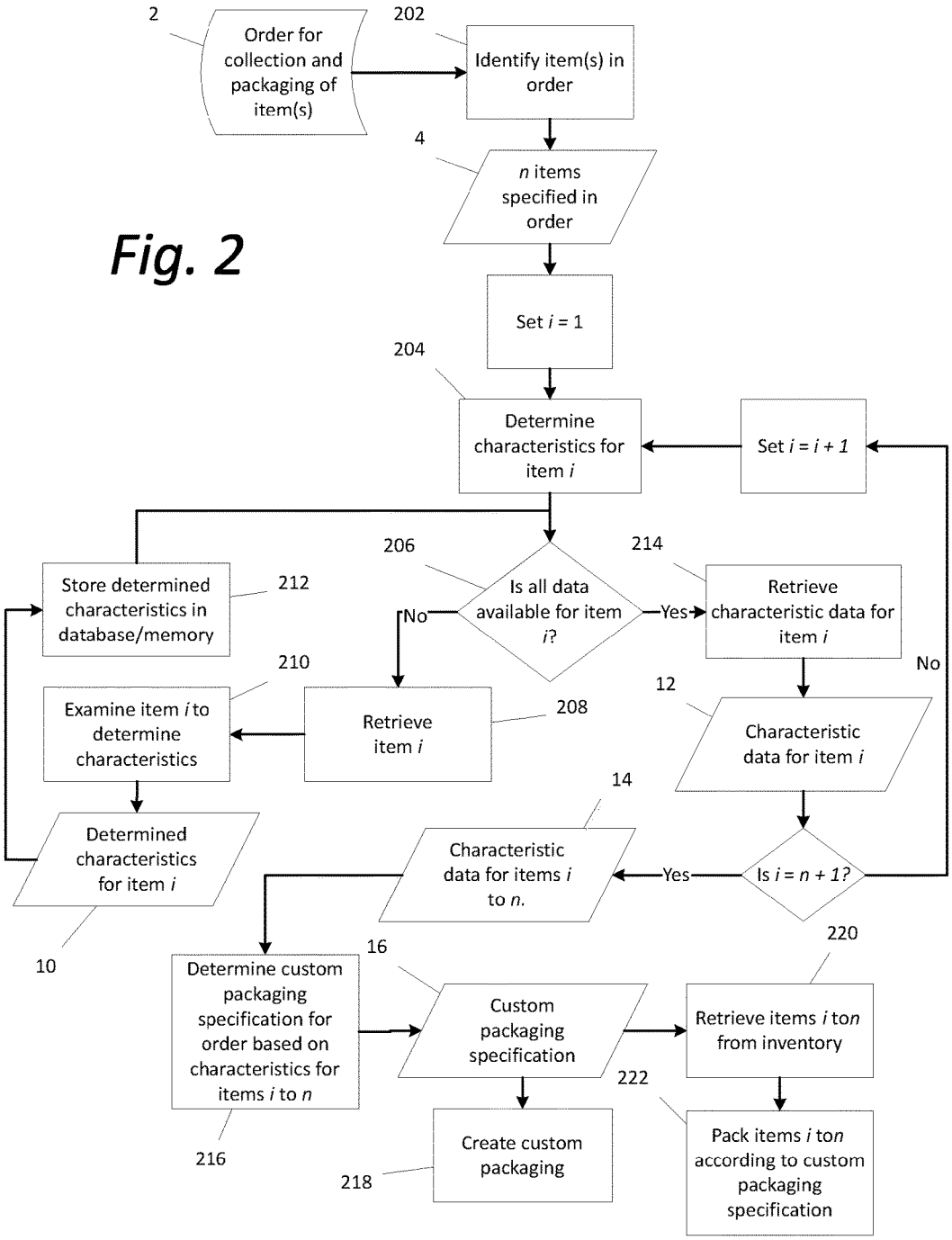
FIG. 2 illustrates a flowchart for an example approach for processing an order, according to aspects of the present disclosure.

The order interface 102 can receive an order 02 as shown in FIG. 2. The processing of order 02 involves retrieving items specified in the order 02 and packing the specified items in custom protective structures. The information in the order 02 is passed to an order processing module 103, which according to act 202 identifies a list 04 specifying quantities of n items i for the order 02.

As described in more detail below, to determine a customized packaging scheme for the order 02, the order system 100 considers various characteristics for each item i. An item database 06 stores data for a catalog of items that may be specified in an order 02, and an inventory module 104 maintains the item data in the database 06. The item data includes various characteristics for each item in the catalog. For example, such characteristic data may include, but is not limited to, shape, size, weight, center of mass, shear strength, bending strength, compression strength, hardness/softness, solid/liquid, material composition, fragility, and value of an item. Therefore, according to act 204, the inventory module 104 receives the list 04 of item(s) i specified in the order 02 and can query the database 06 for characteristic data for each item i.

For each item i among the n items, the inventory module 104 determines at decision 206 whether the database 06 stores all desired characteristic data on the particular item i. Characteristic data on the particular item i may be recorded in the database 06 in advance so that the characteristic data is readily available when an order 02 for the particular item i is received. In some cases, at least some of the characteristic data may be determined in advance by administrators of the order system 100. Additionally or alternatively, at least some of the characteristic data may be provided in advance by a manufacturer or supplier of the particular item i. If the database 06 does include all desired characteristic data on the particular item i in advance, the desired characteristic data is readily retrieved from the database 06 according to act 214.

If, however, all desired characteristic data on the particular item i is not available in the database 06, the order system 100 can actively determine unknown characteristics in some embodiments. Specifically, according to acts 208 and 210, the particular item i can be retrieved and examined in an item analysis system 120. The item analysis system 120, for example, may provide an examination station where personnel and/or machines can examine the item i closely and record the characteristic data in the item database 06 or other memory according to act 212. The item analysis system 120 may include various tools for determining the characteristic data. For example, the item analysis system 120 may include measurement tools, such as rulers, scales, scanning devices, imaging devices, etc., for determining the size, shape, weight, etc., of an item.

In one non-limiting example, the item analysis system 120 can be operated by personnel of a manufacturer, retailer, and/or warehouse. In another non-limiting example, the item analysis system 120 can be included in a shipping kiosk (not shown) configured to receive an order 02 from a shipping customer (e.g., a stand-alone kiosk where the customer can drop of an item for on-demand, custom packaging and shipping). In yet another non-limiting example, personnel can additionally or alternatively manually enter qualitative data (e.g., fragility assessment) or non-physical data (e.g., monetary value) through the item analysis system 120.

Because the order system 100 can determine characteristic data dynamically after an order 02 is received, the order system 100 can accommodate orders 02 for items that are custom designed, configured according to particular specifications in the order 02, or otherwise made-to-order. In other words, the order system 100 can take orders 02 for items with characteristic data that can only be determined after the order 02 is placed. For example, the order system 100 can receive orders 02 for one-of-a-kind artwork or jewelry, custom-designed furniture, specially tailored clothing, etc. Once the characteristic data 10 is determined according to the acts 208 and 210, the determined characteristic data 10 is stored in database 06 or other memory in act 212.

Recording the determined characteristic data 10 in the database 06 allows such data to be available for subsequent orders 02, so that acts 208, 210, and 212 do not have to be subsequently repeated. For example, the characteristic data 10 can include identification information (e.g., a barcode, a serial number, a QR code, an image, a text-based description, etc.) that allows the system to identify the characteristic data 10 stored in the database 06 that is associated with items in subsequent orders 02. In this way, the order system 100 can be configured to continuously learn about new items as orders 02 are received.

Although the embodiment of FIG. 2 allows characteristic data to be determined dynamically after an order 02 is received, it is understood that alternative embodiments may be more highly automated, and as such, all desired characteristic data 12 for a particular item is recorded in the database 06 before an order 02 for the particular item can be received by the order system 100.

Once all desired characteristic data 12 for each item i is retrieved according to act 214, a packaging optimization module 105 processes a combination 14 of the characteristic data 12 and determines a custom packaging specification 16 according to act 216. The custom packaging specification 16 produced by act 216 is then passed to an automated packaging manufacturing system 150. Using the custom packaging specification 16, the automated packaging manufacturing system 150 makes one or more protective structures that are employed to position and protect the items i in one or more respective containers for shipping the order 02. As described in detail further below, the custom packaging specification 16 provides a more optimized approach for arranging the items i three-dimensionally in the shipment containers. The protective structures provide sufficient support to keep the items i in position during movement of the shipment containers, while also absorbing any shocks, impacts, vibrations, or other external forces that may damage the items i.

To produce the custom packaging specification 16, the packaging optimization module 105, for example, may analyze the three-dimensional aspects of the protective structures and the containers according to voxel-based approaches. A voxel describes a three-dimensional volumetric pixel, which can be used to break down any geometry according to any desired resolution or scale. Voxel-based approaches strike a balance between practical manufacturing and material optimization, based on the requisite structural properties.

Any number of criteria can be employed to determine the custom packaging specification 16. The packaging optimization module 105 can take the particular characteristic data of each item i into account. In addition, the packaging optimization module 105 can also consider how the particular combination of quantities of the items i can be optimally packaged. For the combination, the packaging optimization module 105 may determine: (i) what type of containers to use; (ii) how many of each container type to use; (iii) what items to place in each container; and (iv) how the items should be arranged and oriented in each container relative to each other and to the container. Furthermore, the packaging optimization module 105 may consider other aspects of the order 02. For example, the custom packaging specification 16 may take shipment specifications, e.g., distance of shipment, location of recipient, type of shipping vessel (e.g., ground, air, water), environmental conditions during shipment, etc., into account.

A more optimal packaging scheme, for example, may among other considerations:

- use less space for packaging;
- use less packaging material;
- orient the items to maximize use of the container space;
- facilitate package handling by distributing mass of different items more evenly inside the container or lowering the center of gravity or the center of mass inside the container;
- position less valuable items around the periphery of more valuable items;
- strategically enhance protection for more fragile items while providing less protection for less fragile items;
- configure packaging for shipment specifications, e.g., by configuring according to the distance of shipment, location of recipient, type of shipping vessel (e.g., ground, air, water), environmental conditions during shipment, etc.
- facilitate removal of the items by the package recipient;
- present the items to the recipient according to a particular aesthetic scheme (e.g., branding strategy); and/or
- respond to feedback from past recipients regarding possible improvements to packaging, including feedback on items that were damaged during shipment.

Because the custom packaging specification 16 is determined after the order 02 is received, the custom packaging specification 16 can be dynamically customized to account for aspects that may not be known until after the order 02 is placed. For example, the inventory module 104 may determine that a quantity of an item in the order 02 is not in stock, e.g., in the inventory storage 110. As such, the unavailable item may be shipped separately from the rest of the order 02. Responding dynamically to changing inventory levels, the packaging optimization module 105 determines a custom packaging specification 16 that only has to accommodate items that are actually available and that can be included in the present shipment. Designing the packaging before the order 02 is placed (or before available inventory is determined) might otherwise result in manufacturing packaging for items that are not even available for shipment.

While the automated packaging manufacturing system 150 makes the protective structure(s) according to the custom packaging specification 16, an automated picking system 130 acts in parallel to retrieve the items i from inventory storage 110, according to act 222. The computing system 101 includes a picking/packing controller 106 that controls aspects of the automated picking system 130. To enhance efficiency, rapid manufacturing allows the protective structure(s) to be completed or substantially completed during the time generally required to complete the picking process. As such, the protective structure(s) are available (with no delay or with minimal delay) when the items i are ready for packing.

Once the items i have been retrieved, the picking/packing controller 106 causes an automated packing system 140 to pack the items i in the container(s) with the protective structure(s) according to act 224. In particular, the custom packaging specification 16 is employed to direct the automated packing system 140 how each item i should be packed in the custom protective structure(s). If the custom packaging specification 16 designates that the items i are to be shipped in more than one container, the automated packing system 140 packs each subset of items i with its designated protective structure(s) in its designated container. The automated packing system 140 ensures that the subset of items i are properly combined with the protective structure(s) so that they are arranged in the three-dimensional space of the container according to the optimized packaging scheme. In some cases, the automated packing system 140 can move with one or more degrees-of-freedom to manipulate each item i so that the item i is properly placed in the protective structure(s) and/or properly oriented relative to the container and other items i.

The automated picking system 130 and the automated packing system 140 allow some or all aspects of the picking process of act 222 and the packing process of act 224 to be generally achieved without manual input or human intervention. For example, the automated picking system 130 and the automated packing system 140 may employ the picking/packing controller 106 and the packaging manufacturing controller 107, respectively, to control machines, robotic devices, conveying devices, etc., to physically move and manipulate the items i, the protective structures, the containers. and related objects.

Once the automated packing system 140 assembles the items i with the respective protective structures and containers, the containers are prepared for shipment by a shipping system 160. The shipping process can be handled by a shipping module 108 in the computing system 101. For example, the shipping module 108 can prepare shipping documents, schedule delivery of the packaged items i, track delivery, etc. In one example implementation, the shipping module 108 can interface with a package delivery service such as GOOGLE EXPRESS to facilitate same-day delivery of the assembled package to the recipient and/or delivery during the recipient's preferred delivery time window.

As described, the order system 100 illustrated in FIG. 1 includes a computing system 101 to handle aspects of the order process illustrated in FIG. 2. In particular, the computing system 101 includes the order interface 102, the order processing module 103, the inventory module 104, the packaging optimization module 105, the picking/packing controller 106, the packaging manufacturing controller 107, and the shipping module 108. In some cases, the order processing module 103 can manage the other components of the computing system 101 and can coordinate the exchange of data between the various components. The components of the computing system 101 shown in FIG. 1 may represent separate structural and/or logical components. Although the computing system 101 can include the separate components as shown in FIG. 1, it is understood that the components of a computing system 101 can be structurally and/or logically combined, configured, and/or organized in any manner to achieve the functions of an order system 100 according to the present disclosure.

III. Packaging Determination & Optimization

As described above, after all of the characteristic data 14 is retrieved, the packaging optimization module 105 determines a custom packaging specification 16 for creating an on-demand, order-specific packaging of the one or more items i at act 216. The packaging specification 16 can be characterized by, for example, one or more container parameters relating to a container in which the item(s) i will be packaged, one or more arrangement parameters relating to an arrangement for positioning the item(s) i within a three-dimensional space of the container, and one or more protection parameters relating to a protective structure for protectively retaining the item(s) i in the container according to the arrangement.

The container parameter(s) indicate which of a plurality of potential containers is to be utilized by the automated packing system 140 for packing the one or more items i. The potential containers can have, for example, different materials, volumes, dimensions, shapes, and/or sealing mechanisms (e.g., tape, slots and tabs, adhesive, etc.). Additionally or alternatively, for example, the potential containers can have a variety of different construction types (e.g., single face, single-wall, double-wall, etc.), material thicknesses (e.g., flute sizes), and/or performance characteristics (e.g., burst strengths, edge crush strengths, stacking strengths, compression strengths, flat crush characteristics, water resistances, electromagnetic insulation characteristics, temperature insulation characteristics, surface treatments, coatings, etc.). Accordingly, the container parameters can indicate, for example, a type of container (e.g., a material, a thickness, a shape, a volume, dimensions, a sealing mechanism, a construction type, performance characteristics, etc.) and a quantity of containers for packaging the one or more items i according to the packaging specification 16.

Non-limiting examples of materials that can be utilized for the containers include paperboard, plastic, corrugated fiberboard (i.e., cardboard), wood, metal, combinations thereof, and/or the like. According to some aspects, the potential containers can include various different standard-sized boxes that are commonly used for shipping such as, for example, cuboid shaped boxes. According to additional and/or alternative aspects, the plurality of potential containers can include containers having non-standard sizes and shapes such as, for example, irregularly shaped containers (e.g., cylindrical, heart-shaped, triangular pyramid, cone, etc.) or asymmetrically shaped containers. Additionally, for example, one or more of the plurality of potential containers can be configured to contain the item(s) i in a wrap-like manner (e.g., a stretch wrap or a shrink wrap). In general, the container(s) provide a three-dimensional space in which the one or more items i can be held and transported.

The arrangement parameters indicate an arrangement, which is a positioning for each of the one or more items i within the three-dimensional space defined by the container(s) (i.e., an interior space of the container(s)). If, for example, the quantity of containers is greater than one, the arrangement parameters can further include an indication as to which of the one or more items i will be placed in which of the containers.

Figure 3A:
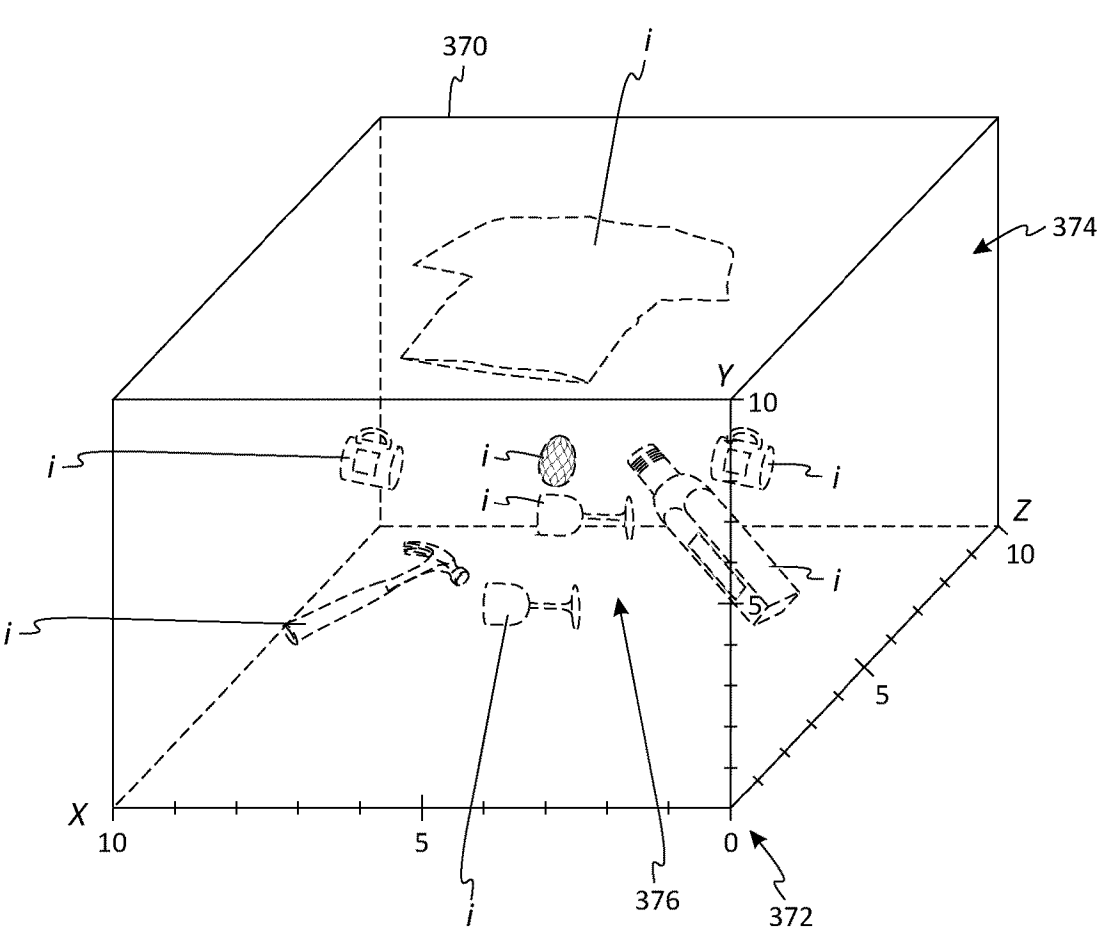
FIG. 3A illustrates an example arrangement of items, according to aspects of the present disclosure.
Figure 3A:
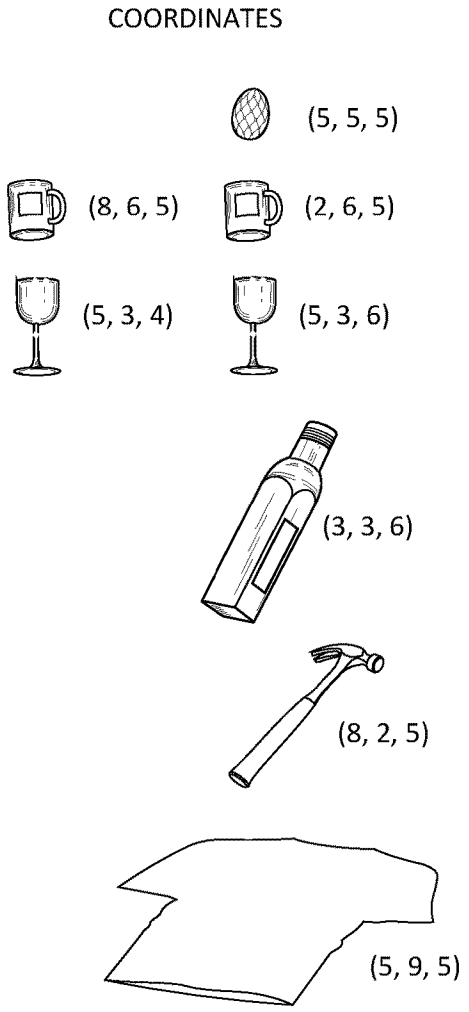

According to some aspects of the present disclosure, a coordinate system (e.g., a Cartesian coordinate system) can be employed to provide a frame of reference for indicating the relative positions (i.e., locations and/or orientations) of the one or more items i with respect to each other and the interior space of the container. FIG. 3A illustrates an example container 370 having an example coordinate system 372 assigned to an interior space 374 of the container 370 (i.e., a container volume 374). As shown in FIG. 3A, a lower corner of the container 370 is located at an origin of the coordinate system 372 with an x-axis extending along a length of the container 370, a y-axis extending along a height of the container 370, and a z-axis extending along a width of the container 370.

As further shown in FIG. 3A, one or more items i are arranged in an example arrangement 376 within the container 370. Each of the one or more items i can be associated with one or more three-dimensional coordinates to indicate the respective portions of the interior space 364 that will be occupied by the one or more items i when positioned in the container 370 according to the arrangement 376. In this way, the packaging optimization module 105 can precisely determine the positioning of each of the one or more items i within the container 370. In some example implementations, the arrangement parameters can be used to communicate the coordinate information to the automated packing system 140, which can utilize the coordinate information to physically place the item(s) i into the proper positions within the container 370 and the protective structure.

According to some aspects of the present disclosure, the coordinate system 372 can also be used to spatially map the characteristic data 14 of the items i to the interior space 364 of the container 370. For example, a three-dimensional data model can be determined for each item i based on the characteristic data 14 relating to the size, shape and/or dimensions. Using a computer-based simulation, the packaging optimization module 105 can spatially map the data model to the coordinate system 372 to determine the portion of the interior space 364 that is to be occupied by the item i when positioned in the container 370 according to the arrangement 376.

According to additional and/or alternative examples, other characteristic data 14 associated with the one or more items i can be mapped to the interior space 364 and the coordinate system 372. For example, the characteristic data 14 (or data models based thereon) relating to a value, a weight, a center of mass, a shear strength, bending strength, compression strength, a hardness/softness (e.g., a durometer value), a state of matter (e.g., solid, liquid, gas), a material composition, a fragility, information about nesting areas into which other items i may be nested, and other properties can be spatially mapped to the interior space 374 of the container 370 by the packaging optimization module 105. As will be described further below, such spatial mapping of the characteristic data 14 can be employed to improve or optimize the packaging specification 16 based on one or more enhancement criteria.

While the example illustrated in FIG. 3A includes a coordinate system 372 having an origin in a corner of a rectangular container 370, it should be understood that the container 370 can have any other shape or size and the origin of the coordinate system 372 can be located at other locations relative to the interior space 374 of the container 370 (e.g., a center of the container 370). Additionally, it should be understood that the x-, y-, and z-axes of the coordinate system 372 can be scaled differently and/or extend in directions other than those illustrated in the example of FIG. 3. Still further, although the illustrated example includes a Cartesian coordinate system 372, it is contemplated that other types of coordinate systems 372 (e.g., a polar coordinate system) can be used in other implementations.

Although a single coordinate point is indicated for each item i in FIG. 3A for clarity, it should be understood that each of the items i can be associated with a plurality of coordinates. According to additional or alternative aspects, the items i and the interior space 374 can be mapped using voxel-based data. In some instances, the resolution of the voxels can be based on the specific items i analyzed. For example, an item i with intricate features can be mapped with greater resolution than another item i having more general features.

The protection parameters indicate information related to the design and manufacture of a protective structure for protecting the one or more items i when positioned within the container 370 according to the arrangement 376. For example, the protective structure can provide both support to retain the items i in the positioning of the arrangement 376 and cushioning to protect the items i during shipment. The protection parameters are communicated to the automated packaging manufacturing system 150, which is configured to manufacture the custom-designed protective structure based on the protection parameters. In other words, the protection parameters enable the protective structure to be produced on-demand and in a customized manner in response to an analysis of the characteristic data 14 associated with the ordered items i. This is in contrast to other systems that select one standard protective structure from a plurality of predefined, standard protective structures (e.g., conventional bubble wrap, air pillows, packing peanuts, loose fill, etc.) based on a mere identification of an item i. The dynamic nature of the protective structures provides for improved or optimized packaging of different orders 02, which may include any combination and number of different items i.

Because the protective structures may be highly customized, the protection parameters can be configured to indicate information that facilitates the manufacture of a vast number of different, potential configurations for the protective structure. For example, the protection parameters can indicate a material composition, a material density, a size, a shape, and/or dimensions of a protective structure that can be manufactured by the automated packaging manufacturing system 150. Non-limiting examples of materials include polymeric foam (e.g., polystyrene, polypropylene, polyethylene, polyurethane, etc.), plastic, pulp, cardboard, compostable materials (e.g., starch-based materials, mushroom-based materials, etc.), bioplastics, fibrous materials, woven materials, other cushioning materials, etc. According to some aspects, the protective structure can be made from a single material. According to alternative aspects, the protective structure can be made from a plurality of materials. For example, the protective structure can be configured to be compliant in one or more select areas and rigid in other areas by forming the protective structure from different materials.

Figure 3B:
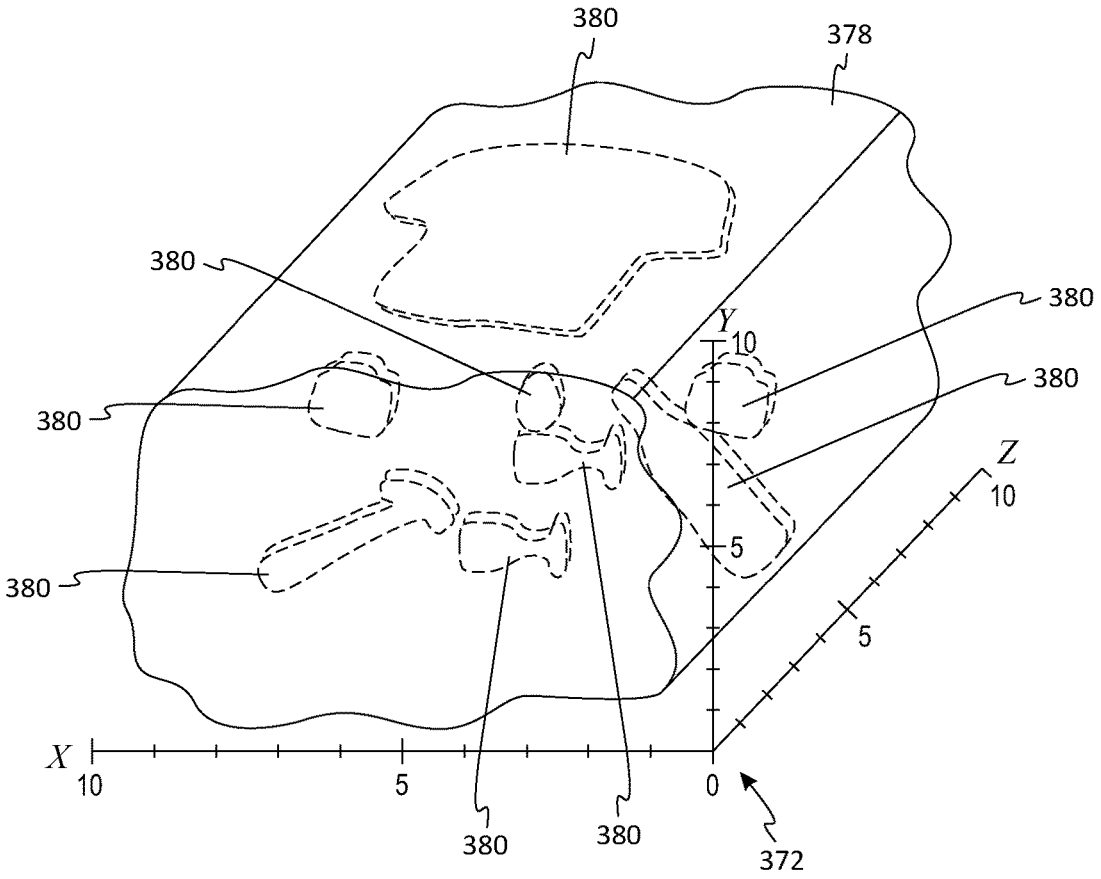
FIG. 3B illustrates an example protective structure for protecting and retaining the items according to the example arrangement of FIG. 3A.

FIG. 3B illustrates an example protective structure 378 including a plurality of cavities 380 for protecting and retaining the items i according to the example arrangement 376 illustrated and described above for FIG. 3A. It should be understood that the protective structure 378 of FIG. 3B is merely one example and that the customized protective structures 378 of the present disclosure can differ in any number of ways described above or below (e.g., a material composition, a material density, a size, a shape, dimensions, etc.).

The protective structure 378 can have a symmetric or an asymmetric shape. According to some aspects, an exterior shape of the protective structure 378 can generally correspond to an internal shape of the container 370. For example, an example protective structure 378 can have an exterior shape that is generally in the shape of a cube, which corresponds to a cube-shaped interior space 374 of an example container 370. According to other aspects, the exterior shape of the protective structure 378 can be different from the internal shape of the container 370. For example, the protective structure 378 can include a plurality of legs that each extend from a main body to a corner of a cuboid container 370. In some instances, the protective structure 378 can be configured to closely fit within the interior space 374 of the container 370 to mitigate impacts due to undesirable movement of the protective structure 378 relative to the container 370.

During shipping, the package may be subject to a number of impacts, vibrations, or other external forces that may potentially damage the one or more items i. To protectively retain the items i in the arrangement 376, the protective structure 378 includes one or more recesses and/or cavities 380 configured to receive the one or more items i according to the arrangement 376 (as shown, e.g., in FIG. 3B). According to some aspects of the present disclosure, each of the recesses and/or the cavities 380 can have a size and a shape that generally corresponds to the size and the shape of a respective one of the one or more items i. Additionally, for example, the recesses and/or the cavities 380 can be oriented according to an orientation of the one or more items i indicated by the arrangement parameters. As the arrangement 376 can include the same or different items i having the same or different shapes and sizes depending on the order 02, the recesses and/or the cavities 380 can be symmetrically or asymmetrically formed within the protective structure 378.

According to some aspects, the one or more recesses and/or cavities 380 are located within an interior of the protective structure 378. That is, the protective structure 378 can at least partially or fully enclose the one or more items i within the protective structure 378 on all sides of the one or more items i. In this way, the protective structure 378 can protect the one or more items i from shocks, vibrations, temperature, humidity, dust, insects, liquids, electrostatic shock, etc., in all six dimensions while at the same time retain the one or more items i in the desired arrangement 376.

It is contemplated that, according to other aspects, the protective structure 378 can additionally include one or more recesses externally located on the protective structure 378. That is, the externally located recesses can be configured so that an item i is not enclosed on all sides. For example, in some instances, an item i might not need to be protected by the protective structure 378 to the same extent as other items i. In such instances, the items i requiring less protection may be located externally on the protective structure 378 while the items i requiring greater protection may be located internally within the protective structure 378. As one non-limiting example, a protective structure 378 for packaging a porcelain figurine and a down coat can include an internal cavity 380 for fully enclosing the porcelain figurine within the protective structure 378 and an external recess for receiving the down coat on an exterior surface of the protective structure 378.

It is further contemplated that, according to additional or alternative aspects, the protective structure 378 can include features other than the recesses and/or cavities 380 for protectively retaining the items i. As non-limiting examples, the protective structure 378 can include one or more clips, rings, areas of increased material density, slots, interlocking geometries, etc for protectively retaining the items i. It is also contemplated that, according to additional or alternative aspects, the protective structure can have an exterior that is configured to withstand the rigors of shipment such that the items i can be transported in the protective structure 378 without a container 370.

In the example illustrated in FIG. 3B, each of the cavities 380 is configured to receive a respective one of the plurality of items i. According to additional or alternative aspects of the present disclosure, one or more of the cavities 380 can be configured to receive a plurality of the items i. For example, according to some aspects, at least two of the items i can be nested with each other in the arrangement 376 and received in a single recess or cavity 380 of the protective structure 378. That is, one item i may be positioned within a nesting area (e.g., a cavity or recess) of another item i. Whether the items i are nestable can be indicated in the characteristic data 14 or determined by the packaging optimization module 105 based on the characteristic data 14 (e.g., size, shape, or dimension information).

According to some aspects, the protective structure 378 can be a unitary structure. For example, the protective structure 378 can be configured as a clamshell-type structure that can be hingedly opened and closed to facilitate insertion and removal of the one or more items i from the one or more recesses and/or cavities 380. According to additional and/or alternative aspects, the protective structure 378 can be a multiple-part construction. For example, the protective structure 378 can include a plurality of separate pieces that can be stacked on top of one another or otherwise engaged to partially or fully enclose the one or more items i within the protective structure 378. In general, the protective structure 378 can have at least two portions that are couplable to form the protective structure 378 and facilitate insertion/removal of at least one of the one or more items i to/from an enclosed position within the protective structure 378.

According to some aspects of the present disclosure, the protective structure 378 can be spatially mapped to the interior space 374 of the container(s) 370 using the coordinate system 372 and/or voxel-based data described above. For example, the size, shape, and/or dimensions of the protective structure 378 can be mapped to the interior space 374 and the coordinate system 372 (e.g., via a data model of the protective structure 378). The coordinates and/or voxel-based data associated with the protective structure 378 can thus indicate the portions of the interior space 374 that will be occupied by the protective structure 378 when the protective structure 378 is positioned in the container 370.

According to some example implementations, the coordinate information and/or the voxel-based data associated with protective structure 378 can be included in the protection parameters and communicated to the automated packaging manufacturing system 150 to facilitate the manufacture of the protective structure 378. Additionally, for example, the coordinate information and/or the voxel-based data associated with the protective structure 378 and the arrangement 376 can be utilized by the packaging optimization module 105 to ensure that the one or more recesses and/or cavities 380 are consistent with the arrangement 376 of the one or more items i and vice versa (as shown, e.g., by FIG. 3A and FIG. 3B).

In addition to spatially mapping the size, shape, and/or dimensions of the protective structure 378, the coordinate system 372 can be employed to spatially map one or more protection characteristics of the protective structure 378 to the interior space 374 of the container 370. The one or more protection characteristics can include, for example, metrics for quantifying and/or characterizing an amount of protection provided by the protective structure 378 against shocks, vibrations, thermal effects, humidity effects, air pressure effects, dust, insects, liquids, static electricity, combinations thereof, and/or the like. The one or more protection characteristics can additionally or alternatively relate to, for example, an amount of resiliency (i.e., an capability to withstand multiple impacts) and/or an amount of resistance to creep (i.e., deformation under a static load) of the protective structure 378. Still further, the one or more protection characteristics can relate to other factors that may affect the processes for determining and/or evaluating a protective structure 378 such as, for example, a material cost, an environmental impact of the material, whether a material is out of stock, an amount of energy required to produce the protective structure, etc. By spatially mapping the one or more protection characteristics, informed decisions can be made as to the design and implementation of a protective structure 378 customized for a specific order 02 of the one or more items i.

As described above, the custom packaging specification 16 is determined based on the characteristic data 14 of the one or more items i. For example, the custom packaging specification 16 can include a protective structure 378 having recesses and/or cavities 380 that correspond to the shapes and sizes of the one or more items i indicated by the associated characteristic data 14. According to additional aspects of the present disclosure, the custom packaging specification 16 can be further determined by the packaging optimization module 105 by processing the characteristic data 14 using one or more design criteria that provide a framework for achieving desired packaging objectives. For example, the design criteria can include one or more enhancement criteria and/or one or more design constraints described further below. Additionally, for example, the one or more design criteria can define a set of relationships (e.g., if-then rules) between the characteristic data 14, the enhancement criteria, and/or the design constraint(s) (e.g., if the characteristic data 14 for an item i indicates that the item i is worth more than X dollars, then the packaging specification 16 is designed to protect the item i from an impact of at least Y force).

The enhancement criteria can be employed by the packaging optimization module 105 to custom design a more optimal custom packaging specification 16 for the specific collection of items i in the order 02. Non-limiting examples of enhancement criteria include packaging efficiency criteria, cost criteria, protection criteria, package handling criteria, and/or aesthetics criteria.

The packaging efficiency criteria can relate to an amount of material required to implement a custom packaging specification 16 (i.e., an amount of material for forming the container 370 and/or an amount of material for forming the protective structure 378). The packaging efficiency criteria can be thus utilized to reduce or minimize the amount of material required to package the one or more items i, which may reduce the costs and the environmental impact associated with packaging and shipping the one or more items i.

The cost criteria can relate to a cost associated with a custom packaging specification 16. For example, the cost criteria can be based on a cost of materials for the container(s) 370, a cost of materials for the protective structure(s) 378, one or more freight rates for shipping the assembled package (e.g., based on a size and/or a weight of the assembled packages), and/or an amount of time or resources (e.g., labor or machinery) required to assemble the package according to a particular custom packaging specification 16. The cost criteria can be thus utilized to reduce or minimize the cost associated with packaging and shipping the one or more items i.

The protection criteria can relate to an amount or a type of protection that is provided for each of the one or more items i due to the container(s) 370, the protective structure(s) 378, and/or the arrangement 376. For example, the protection criteria can relate to the protection provided by the custom packaging specification 16 for shocks, vibrations, thermal effects, humidity effects, air pressure effects, dust, insects, liquids, static electricity, combinations thereof, and/or the like. The protection criteria can additionally or alternatively relate to, for example, an amount of resiliency (i.e., a capability to withstand multiple impacts), an amount of resistance to creep (i.e., deformation under a static load), a burst strength, an edge crush strength, a stacking strength, a compression strength, flat crush characteristics, etc. The protection criteria can be thus utilized to improve or maximize the protection provided to the items i during shipping. In some embodiments, aspects of the protection criteria (as well as other criteria) can be determined from feedback received from past recipients. For example, past recipients may provide feedback regarding items that were damaged during shipment. Using this feedback, the protection criteria can be improved to provide more effective protection for the items. For example, it may be determined that certain items require more cushioning or need to be arranged away from the sides of the container in order to reduce damaging shocks during shipment.

The package handling criteria can relate to a distribution of weight and other stability aspects of the custom packaging specification 16. If the weight within the container 370 is too unevenly distributed (e.g., top heavy or side heavy), a package may be difficult to handle and more likely to be dropped. By more evenly distributing the weight of the one or more items i and/or the protective structure 378, the risk of damage may be reduced or mitigated. According to one non-limiting example, the package handling criteria can relate to a distance between a center of gravity of a package assembled according to the package specification and a target center of gravity location of the container 370 (e.g., a center point of the interior space of the container 370 or a center area within the container 370). The closer (i.e., more aligned) the center of gravity of the custom packaging specification 16 is to the target center of gravity location, the greater the balance and stability of the custom packaging specification 16.

The aesthetics criteria can relate to the aesthetics of a custom packaging specification 16. For example, the aesthetics criteria can relate to a positioning or distribution of the one or more items i in the custom packaging specification 16. In an example implementation, a custom packaging specification 16 may be considered more aesthetically pleasing if a greater number of the one or more items i are immediately viewable when the protective structure 378 is opened. In another example implementation, a custom packaging specification 16 may be considered more aesthetically pleasing if preferred portions of the one or more items i (e.g., a portion including a graphic or label) are immediately viewable when the protective structure 378 is opened. In still another example implementation, a custom packaging specification 16 may be considered more aesthetically pleasing if the positioning of the one or more items i conveys a sense of symmetry, proportionality, and/or order to a recipient. According to additional and/or alternative examples, the aesthetic criteria can include an indication as to whether certain types of protective structures 378 and/or containers 370 are considered to be more aesthetically pleasing than other types of protective structures 378 based on, for example, a material, a shape, a size, a color, and/or a coating on the protective structure 378 and/or the container 370. For example, due to the level of customization that may be achieved by the system 100, uniquely shaped protective structures 378 may have artistic value.

According to some aspects of the present disclosure, the packaging optimization module 105 can be configured to first determine a plurality of alternative packaging specifications 16 based on the characteristic data 14 of the one or more items i and then select one of the alternative packaging specifications 16 based on the one or more enhancement criteria. The plurality of alternative packaging specifications 16 can be determined using one or more algorithms configured to design a custom packaging specification 16 based on part or all of the available characteristic data 14 for the one or more items i. As one non-limiting example, the one or more algorithms can include a nesting algorithm and/or a volumetric optimization algorithm, which can minimize airspace in the container 370, thereby reducing the volume of the assembled package and saving space on trucks.

Additionally, for example, the design algorithms can determine the alternative packaging specifications 16 based on a set of design constraints (e.g., minimum requirements, preferences, etc.). The design constraints can be determined based on the analysis of the characteristic data 14 and can relate to any aspect of the container 370, the arrangement 376, and/or the protective structure 378 described above (e.g., material, shape, size, dimensions, performance characteristics, protection characteristics, number of containers 370, number of protective structures 378, etc.). As one non-limiting example, a design constraint can indicate that the custom packaging specifications 16 should be capable of withstanding an impact of at least a threshold g-force without damage to the items i. As another non-limiting example, a design constraint can indicate that a package assembled according to a custom packaging specification 16 cannot exceed a maximum threshold weight or a maximum threshold size. Additionally, for example, the design constraint can be based on information indicated in the order 02. For example, the order 02 can indicate that a particular shipper, a particular size container, a particular type of packaging material, etc. be used.

In some example implementations, the number of alternative packaging specifications 16 that are designed and evaluated by the packing optimization module 105 can be based on an estimated time required to retrieve the items i by the automated picking system 130. For example, the packaging optimization module 105 can be communicatively coupled to the order processing module 103 and/or the inventory module 104 to receive information about the estimated to time for retrieving the items i. Accordingly, the packaging optimization module 105 can ensure that the custom packaging specification 16 is ready by the time the items i arrive for packing (or at least minimize delays).

According to some aspects, the custom packaging specification 16 that is utilized by the automated packaging manufacturing system 150 and the automated packing system 140 can be selected from the plurality of alternative packaging specifications 16 based on a single enhancement criterion. As one non-limiting example, the characteristic data 14 of the one or more items i can be processed to determine a custom packaging specification 16 that is configured to utilize the least amount of material for the protective structure 378 regardless of any other enhancement criteria. As another non-limiting example, the characteristic data 14 of the one or more items i can be processed to determine a custom packaging specification 16 that will cost the least amount to produce and ship to a destination indicated in the transaction details of an order 02.

According to other aspects of the present disclosure, the packaging optimization module 105 can be configured to determine a custom packaging specification 16 for the one or more items i based on a plurality of the enhancement criteria. In many implementations, there may not be one custom packaging specification 16 that can be considered the best for all of the enhancement criteria. Rather, it may be that there are tradeoffs associated with the enhancement criteria. For example, a custom packaging specification 16 that costs the least may not provide the most protection for the one or more items i. As another example, an arrangement 376 that is the most aesthetically pleasing may unevenly distribute the weight of the one or more items i such that the container 370 is difficult to handle.

To select one of the plurality of alternative packaging specifications 16 based on a plurality of enhancement criteria, the packaging optimization module 105 can be configured to employ one or more multiple-criteria decision analysis (MCDA) algorithms. Non-limiting examples of the one or more multiple-criteria decision analysis algorithms can include an aggregated indices randomization method (AIRM), an analytic hierarchy process (AHP), an analytic network process (ANP), a data envelopment analysis, a decision expert (DEX), a dominance-based rough set approach (DRSA), an elimination and choice expressing reality (ELECTRE) analysis, an evidential reasoning approach (ER), a goal programming application, a multi-attribute global inference of quality (MAGIQ) analysis, a multi-attribute utility theory (MAUT), a multi-attribute value theory (MAVT), a potentially all pairwise rankings of all possible alternatives (PAPRIKA) analysis, a technique for the order of prioritization by similarity to ideal solution (TOPSIS) analysis, a value analysis (VA), a weighted product model (WPM), a weighted sum model (WSM), combinations thereof, and/or the like.

Figure 4:
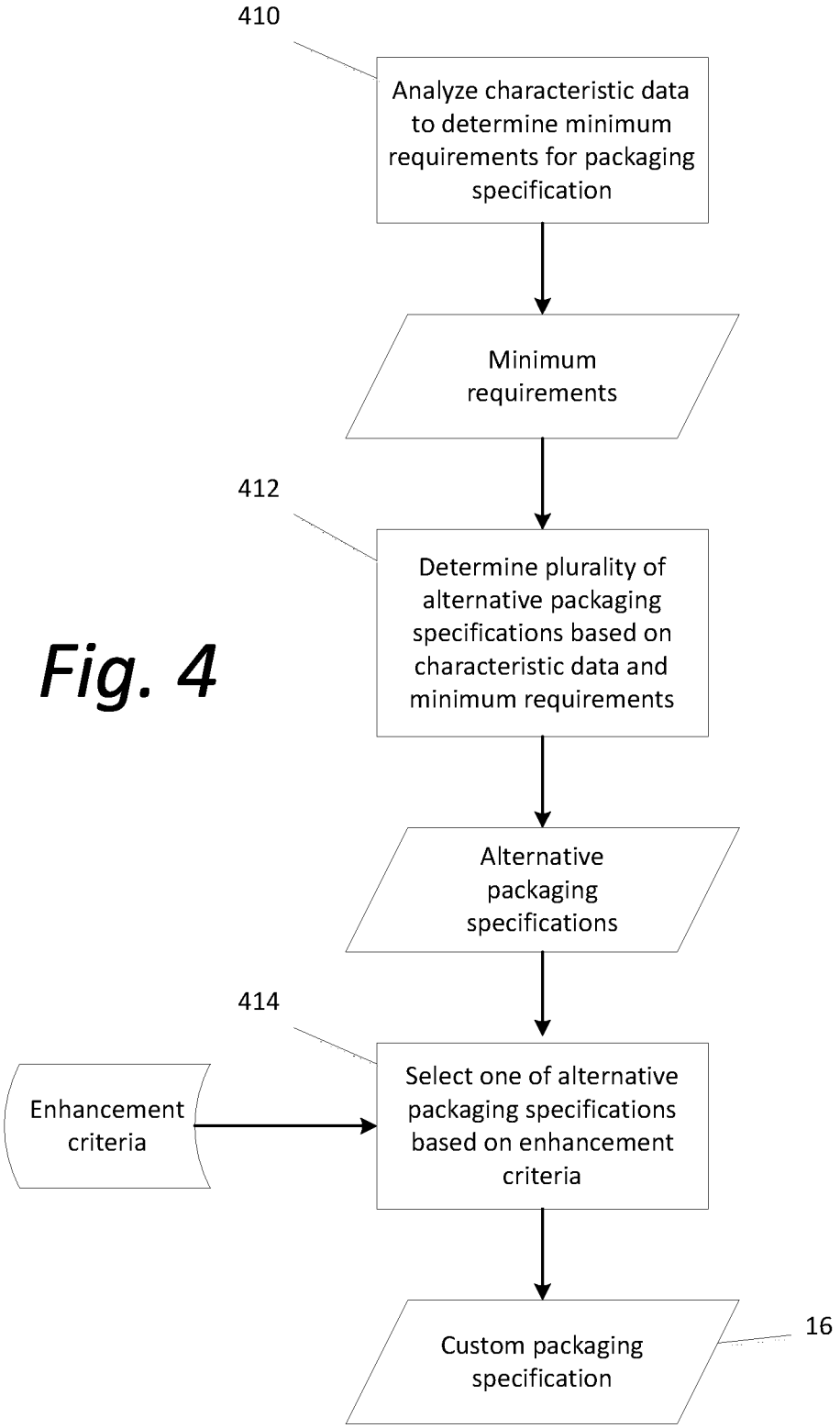
FIG. 4 illustrates a flowchart for an example approach for determining a packaging specification, according to aspects of the present disclosure.

Referring now to FIG. 4, an example subroutine for determining a custom packaging specification 16 based on one or more enhancement criteria is illustrated. At act 410, the characteristic data 14 for the one or more items i of an order 02 is analyzed to determine a set of design constraints for the custom packaging specification 16. At act 412, a plurality of alternative packaging specifications 16 are determined based on the characteristic data 14 and the design constraints. At act 414, one of the plurality of alternative packaging specifications 16 is selected based on one or more enhancement criteria. For example, a multiple-criteria analysis decision algorithm can be utilized to select the one packaging specification 16 from the plurality of alternative packaging specifications 16.

According to some aspects of the present disclosure, the packaging optimization module 105 can simulate how each alternative packaging specification 16 would perform under various test conditions to can evaluate the potential alternative packaging specifications 16. For example, the packaging optimization module 105 can employ physics-engine software for simulating drops from various heights, compressions under various loads, vibrations, thermal effects, etc. According to additional or alternative aspects of the present disclosure, the packaging optimization module 105 can utilize the spatial mapping of the data models for the items i, the protective structure, and the container 370 to run the simulations and identify where potential points of failure or weakness may be located. It is contemplated that, according to some aspects of the present disclosure, the packaging optimization module 105 can be configured to determine an initial set of alternative packaging specifications 16, analyze the initial set based on the simulations, and then modify one or more of the alternative packaging specifications 16 based on an outcome of the simulations. In some instances, the simulation, analysis, and modification process may be iteratively repeated until no further improvements are achieved.

It is further contemplated that, according to some embodiments, the order system 100 can include one or more user input/output devices (not shown) for facilitating user review and modifications to one or more of the alternative packaging specifications 16. For example, a display device can be configured to display information related to the packaging specifications 16 in the form of text, numbers, and/or graphics (e.g., information related to materials, shapes, sizes, dimensions, performance characteristics, protection characteristics, number of containers 370, number of protective structures 378, simulation data, spatial mapping graphics, etc.). Additionally, for example, a keyboard, a mouse, and/or a touch screen can be configured to allow a user to modify aspects of the packaging specification 16 to further customize the packaging specification 16.

FIG. 4, described by way of example above, represents one algorithm that corresponds to at least some instructions executed by one or more processor(s) to perform the above described functions associated with the described concepts. It is also within the scope and spirit of the present concepts to omit steps, include additional steps, and/or modify the order of steps presented above. Additionally, it is contemplated that one or more of the steps presented above can be performed simultaneously. For example, the plurality of alternative packaging specifications 16 can be determined first, the design constraints can be determined thereafter, and then the alternative packaging specifications 16 can be compared to the design constraints to eliminate from further consideration any packaging specifications 16 that do not meet the design constraints. As another example, the plurality of alternative packaging specifications 16 can be determined based on the characteristic data 14 and the one or more enhancement criteria first and then one or more multiple-criteria decision analysis algorithms can be utilized to select a custom packaging specification 16. Still further, it is contemplated that, according to alternative aspects of the present disclosure, a single packaging specification 16 can be determined based on a single algorithm with the characteristic data 14, one or more enhancement criteria, and optionally one or more design constraints as inputs. That is, the custom packaging specification 16 can be determined without determining a plurality of alternatives from which to choose.

According to some aspects of the present disclosure, the container parameters, the arrangement parameters, and the protection parameters can be interdependently determined together. According to some alternative aspects of the present disclosure, one or more of the container parameters, the arrangement parameters, and the protection parameters can be determined independently of the others. As one non-limiting example, to minimize the overall size of an assembled package, the arrangement 376 can be determined first, then the protective structure 378 can be determined based on the arrangement 376, and then the container 370 can be determined based on the protective structure 378.

Figure 3C:
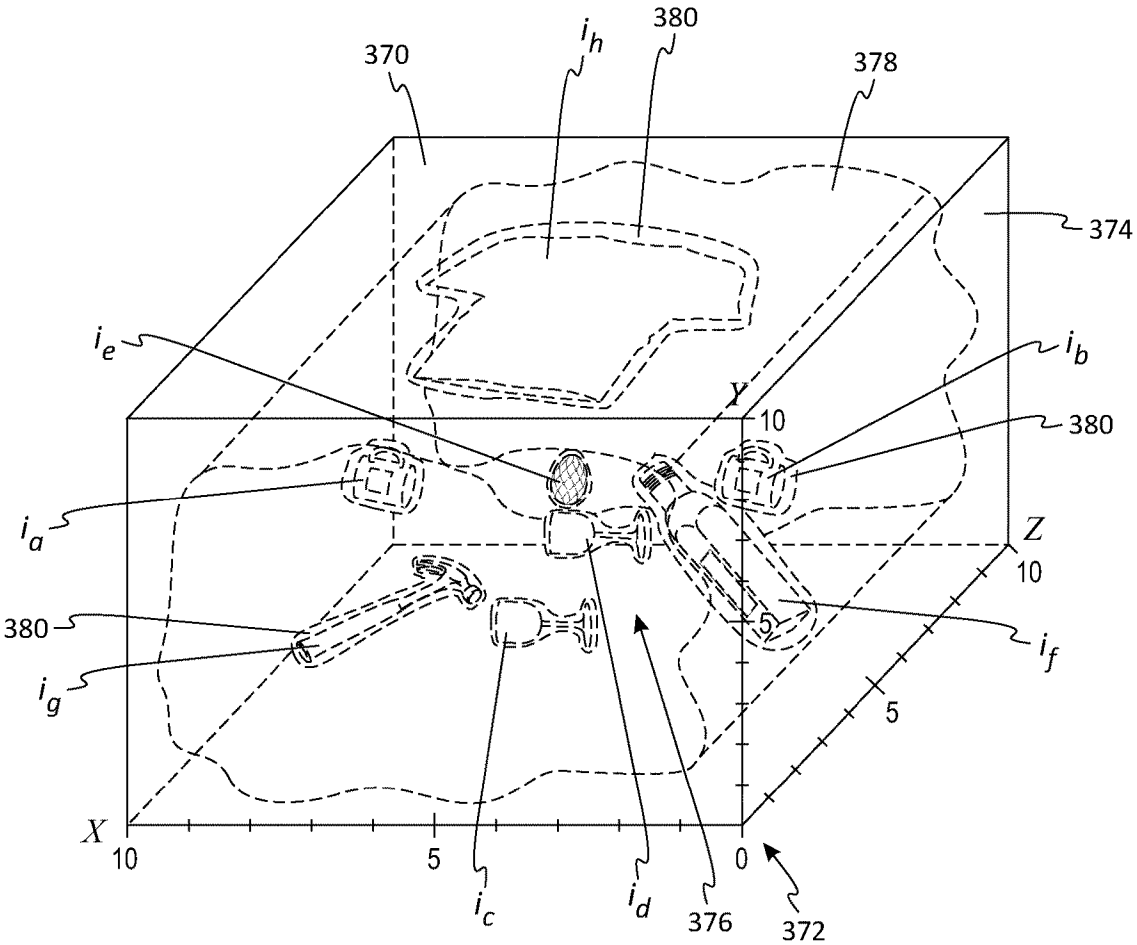
FIG. 3C illustrates the container, arrangement, and protective structure of FIGS. 3A-3B assembled according to an example packaging specification.
Figure 3C:
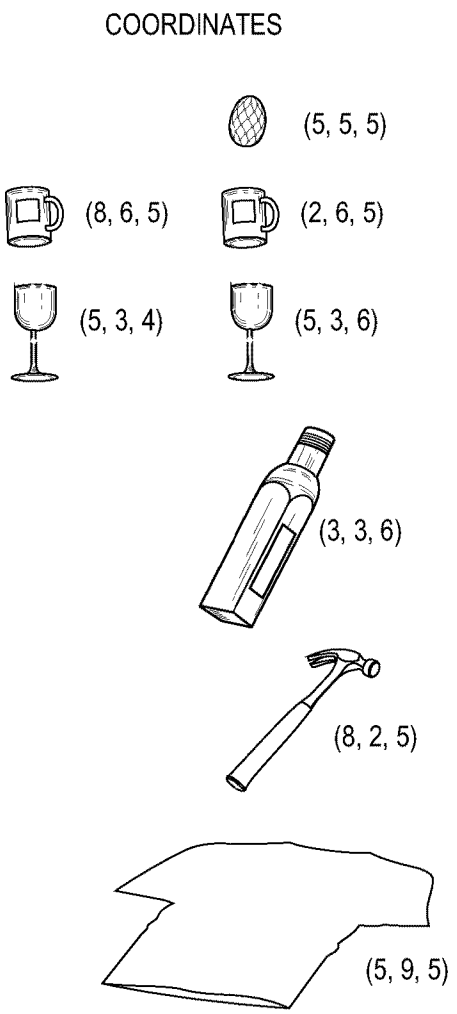

To illustrate some example features of a custom packaging specification 16 that may be determined based on the characteristic data 14 and the enhancement criteria, FIG. 3C illustrates an example packaging specification 16 for the examples of FIGS. 3A-3B. In the illustrated example, the n items i include a first coffee mug $i_a$, a second coffee mug $i_b$, a first glass a second glass $i_d$, a porcelain egg $i_e$, an olive oil bottle $i_f$ a hammer $i_g$, and a t-shirt $i_h$. The characteristic data 14 associated with the items i can indicate, amongst other things, that the coffee mugs $i_a$, $i_b$ include a graphic on a portion of an exterior surface, a stem and a rim of the glasses are particularly fragile, the porcelain egg $i_e$ is a particularly valuable item i, the olive oil bottle $i_f$ and the hammer $i_g$ are heavier items i, and the t-shirt $i_h$ is not fragile.

In the example packaging specification 16 of FIG. 3C, the arrangement 376 of the packaging specification 16 has been optimized (e.g., based on the protection criteria) to provide additional protection to the valuable porcelain egg $i_e$ and the fragile glasses $i_c$, $i_d$ by positioning those items i in a central area within the protective structure 378 and the container 370. The more centrally located the items i, the more protected the items i are likely to be. Additionally, the arrangement 376 has been optimized (e.g., based on the package handling criteria) to evenly distribute the weight of the items i within the interior space 374 of the container 370 to improve package handling. For example, as indicated by the coordinates associated with the items i, the porcelain egg $i_e$ is positioned at a center point (i.e., a coordinate (5, 5, 5)) of the container 370, the t-shirt $i_h$ is positioned above the center point, the coffee mugs is $i_h$ are positioned equidistantly from the center point, the glasses $i_c$, $i_d$ are positioned equidistantly from the center point, the glasses $i_c$, $i_d$ are offset perpendicularly relative to the coffee mugs $i_a$, $i_b$, and the olive oil bottle $i_f$ and the hammer $i_g$ are spaced from the center point to balance each other out. In particular, because the olive oil bottle $i_f$ is heavier than the hammer $i_g$, the olive oil bottle $i_f$ is positioned slightly closer to the center point than the hammer $i_g$. In the example illustrated in FIG. 3C, the arrangement 376 is also configured (e.g., based on the aesthetic criteria) such that the coffee mugs $i_a$, $i_h$ and the porcelain egg $i_e$ are immediately viewable when the protective structure 378 is opened. Additionally, the coffee mugs $i_a$, $i_b$ positioned in the arrangement 376 are oriented such that the graphic image on the coffee mugs $i_b$ is viewable when the protective structure 378 is opened.

In the example packaging specification 16 of FIG. 3C, the protective structure 378 of the packaging specification 16 has been optimized (e.g., based on protection criteria) to have a greater amount of material adjacent to the porcelain egg $i_e$ due to its value as compared to the other items i, which are not considered to be as valuable. Additionally, the protective structure 378 has been optimized to have a different type of material adjacent to the rim and the stem of the glasses $i_c$, $i_d$ as compared to the rest of the glasses $i_c$, $i_d$ due to the fragility of the rim and the stem. In particular, the material adjacent to the stem and the rim of the glass $i_c$, $i_d$ can be configured to be compliant while the material adjacent to the rest of the glass $i_c$, $i_d$ rigid. In this way, the protective structure 378 can minimize the risk of damage to the stem and the rim of the glasses $i_c$, $i_d$ with the compliant material while firmly holding the glasses $i_c$, $i_d$ in place with the rigid material. Still further, the protective structure 378 has been optimized (e.g., based on the packaging efficiency criteria) to have a minimal amount of material adjacent to the t-shirt $i_h$ because the t-shirt $i_h$ is not considered to be fragile and may itself act as a cushioning material to assist in protecting the items i beneath it.

In the example packaging specification 16 of FIG. 4, the container 370 of the packaging specification 16 has been optimized to have a sufficient volume to accommodate the arrangement 376 of items i and the protective structure 378 while closely fitting to the size of the protective structure 378. Additionally, the container 370 is made from a cardboard material having a flute size determined to provide performance characteristics that combine with the protection characteristics of the protective structure 378 to meet or exceed design constraints (e.g., minimum requirements) for protecting the items i.

Other potential features of a custom packaging specification 16 that can be determined based on the enhancement criteria include, for example, providing additional material for the protective structure 378 in select areas to improve the protection characteristics of the protective structure 378 for a fragile item i or a valuable item i. Additionally, for example, the custom packaging specification 16 can be configured to include less material for the protective structure 378 or an aperture in the protective structure 378 adjacent to items i that are less fragile or valuable. As yet another example, the custom packaging specification 16 can be configured to include a plurality of containers 370 to reduce shipping costs due to the weight and the size of the assembled containers 370. As still another example, the custom packaging specification 16 can be configured to separate items i into different containers 370 based on regulatory requirements mandating that certain items i be shipped individually or under particular circumstances that may not be necessary or desirable for other items i. As yet another example, the custom packaging specification 16 can be configured to have varying densities of materials for the protective structure 378 to vary the protection characteristics for different items i (e.g., areas with denser material may provide more protection than less areas with less dense material). In another example, the custom packaging specification 16 can be configured such that a center of gravity of the protective structure 378 is designed to counter an imbalance due to a center of gravity of the arrangement 376 of items i and vice versa. In a further example, the custom packaging specification 16 can be configured to nest a plurality of items i to reduce the amount of material, the volume of the container 370, the empty air space in the container 370, and the costs. In yet another example, the custom packaging specification 16 can be configured to minimize the number of separate pieces that comprise the protective structure 378. In still another example, the custom packaging specification 16 can be optimized to reduce an associated environmental impact due to, for example, an amount of energy required to manufacture the protective structure 378 and/or pack the items i, an amount of waste associated with the manufacture of the protective structure 378, and/or the types of materials utilized in the packaging specification 16. In another example, the packaging specification 16 can be optimized to make it easy for a recipient to unpack the items i from the container 370. It should be understood that the features for a custom packaging specification 16 described and illustrated for FIG. 3C are but a few examples and many other features for the packaging specification 16 are contemplated by the present disclosure.

After the custom packaging specification 16 is determined at act 216, the protection parameters are communicated from the packaging optimization module 105 to the packaging manufacture controller 107. At act 218, the protective structure 378 is manufactured by the automated packaging manufacturing system 150, controlled by the packaging manufacture controller 107, according to the protective parameters of the custom packaging specification 16. The automated packaging manufacturing system 150 is configured to rapidly manufacture the protective structure 378. Rapid manufacturing allows the protective structure 378 to be completed or substantially completed during the time generally required to complete the picking process described further below.

According to some aspects, the protective structure 378 can be formed using an additive manufacturing process. For example, the protective structure 378 can be formed by a 3D printing process, which forms the protective structure 378 by laying down a plurality of successive layers of material. According to some additional or alternative aspects, the protective structure 378 can be formed using a subtractive manufacturing process. For example, a cutting process, a milling process, a drilling process, and/or an ablation process can be employed to remove controlled amounts from a raw material to form the protective structure 378. According to further additional or alternative aspects, the protective structure 378 can be formed by a stamping process, a casting process, a molding process, a forming process, a machining process, and/or a joining process. In general, however, the protective structure 378 can be formed by reshaping a packaging material. Depending on the manufacturing process or the materials employed, the forming of the protective structure 378 can also include a curing process.

According to some aspects of the present disclosure, the protective structure 378 can be manufactured based on the coordinate information and/or voxel-based data for the protective structure 378 indicated by the protection parameters. For example, the automated packaging manufacturing system 150 also can employ a coordinate system 372 that provides a frame of reference for a work space upon which the protective structure 378 is manufactured such that the coordinate information and/or voxel-based data of the protective structure 378 can be mapped to the coordinate system 372 of the automated packaging manufacturing system 150.

IV. Picking Process

Figure 5:
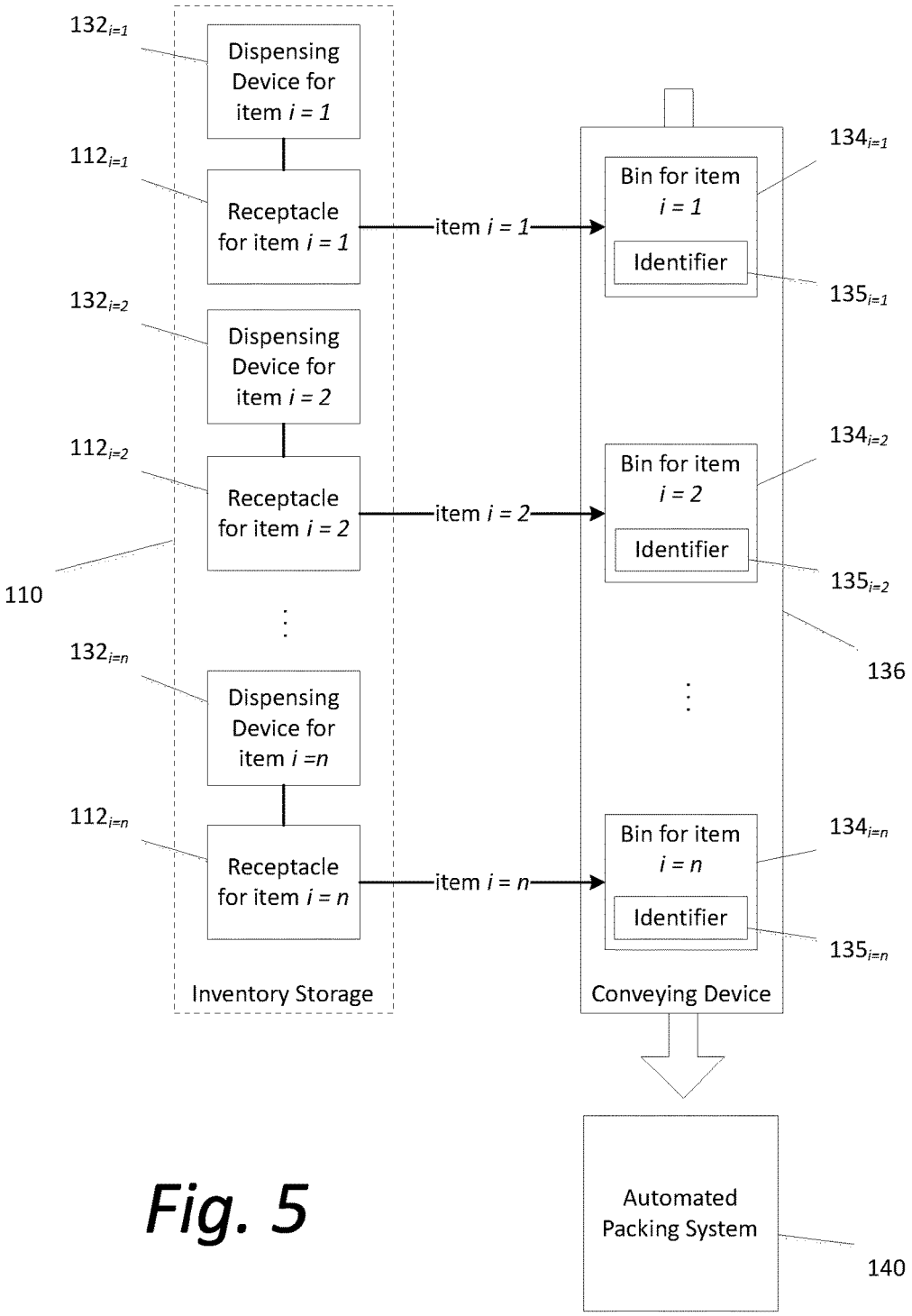
FIG. 5 illustrates an example system for picking items in an order, according to aspects of the present disclosure.

As described above, the automated picking system 130 shown in FIG. 1 retrieves items i for the order 02 from the inventory storage 110. Referring to FIG. 5, an example implementation of the automated picking system 130 is illustrated.

As shown in FIG. 5, the inventory storage 110 includes receptacles 112 for storing respective inventories of the n items i specified in the order 02. In particular, a receptacle $\mathbf{112}_{i=1}$ stores an inventory of the item i=1, a receptacle $\mathbf{112}_{i=2}$ stores an inventory of the item i=2, . . . , and a receptacle $\mathbf{112}_{i=n}$ stores an inventory of the item i=n. Of course, although not shown, it is understood that the inventory storage 110 may include inventories of items that are not specified in the order 02 but that may be specified in other orders. Information about the inventories of items in the inventory storage 110 may be maintained in the item database 06. In addition, the inventory module 104 of the computing system 101 may process information relating to the inventories of items in the inventory storage 110.

When the order 02 is received by the order system 100, the picking/packing controller 106 of the computing system 101 causes the automated picking system 130 to retrieve the desired quantities of items i=1, 2, . . . , n from their respective receptacles 112*i*. In the example of FIG. 5, it is assumed that the inventory storage 110 stores the desired quantities of items i=1, 2, . . . , n specified in the order 02. As described above, however, the shipment of an order 02 may be dynamically modified if the inventory module 104 determines that there is insufficient inventory to fulfill a request for one or more of the items i=1, 2, . . . , n specified in the order 02. In general, the automated picking system 130 can retrieve available items for partial order shipment, and subsequent partial order shipments can be additionally made as the other items become available.

The automated picking system 130 provides a dispensing device 132*i* for each receptacle 112*i*. Each dispensing device 132*i* moves the desired quantity of item i from the receptacle 112*i* to a respective bin 134*i*. The bins 134 move on a conveying device 136 that passes near the receptacles 112. For each item i, the automated picking system 130 operates the conveying device 136 to position the bin 134*i* near the receptacle 112*i* and then operates the dispensing device 132*i* to move the specified quantity of item i into the bin 134*i* on the conveying device 136.

Each dispensing device 132*i* may be individually controlled by the automated picking system 130. For example, each dispensing device 132*i* may include an electromechanically and/or hydraulically actuated mechanism that pushes the desired quantity of item i into the bin 134*i* from the receptacle 112*i*. The items i may be arranged in the receptacle 112*i* to allow the mechanism to push one item i at a time from the receptacle 112*i*. Furthermore, a surface, e.g., an inclined surface defined by a series of rollers, may lead from the receptacle 112*i* to the bin 134*i* to facilitate the transfer of the item i.

The automatic picking system 130 assigns each bin 134*i* to the respective items i, i.e., bin 134*i*=1 is assigned to item i=1, bin 134*i*=2 is assigned to item i=2, . . . , bin 134*i*=n is assigned to item i=n. Knowing these bin assignments, the automatic picking system 130 can determine where the retrieved items i=1, 2, . . . , n are by tracking the locations of bin 134*i*=1, bin 134*i*=2, . . . , bin 134*i*=n, respectively. Accordingly, each bin 134*i* includes an identifier 135*i* that allows the automated picking system 130 to track the location of the bini. For example, the identifier 135*i* may include a barcode and/or other marking that can be read by image capture and/or scanning devices at various locations. Additionally or alternatively, the identifier 135*i* may include a radio-frequency identification (RFID) or other signal-emitting device that can be used to track the bin 134*i* wirelessly.

After the items i=1, 2, . . . , n have been transferred from the receptacles 112*i* to the bins 134*i*, respectively, the automated picking system 130 operates the conveying system 136 to move the bins 134 to a designated location for packing by the automated packing system 140. During the picking process, the automated picking system 130 may also retrieve items for other orders. The bins 134 for the order 02 may then become interspersed with bins for other orders. As such, the automated picking system 130 tracks the location of the bins 134 with the items i=1, 2, . . . , n so that they are conveyed on the conveying device 136 in the proper direction and deliver the items i=1, 2, . . . , n to the appropriate location for packing.

This picking process occurs in parallel with the process of determining and manufacturing the protective structure(s) 378 described above. Rapid manufacturing allows the protective structure(s) 378 to be completed or substantially completed during the time generally required to complete the picking process. As such, the protective structure(s) 378 are available (with no delay or with minimal delay) when the items i=1, 2, . . . , n are ready for packing. The proper protective structure(s) 378 are also conveyed to the appropriate location to be assembled with the retrieved items i=1, 2, . . . , n for packing.

Although FIG. 5 illustrates a single linear configuration of receptacles 112 and a single linear path for the conveying device 136 for clarity, it is understood that any number of conveying devices 136 may extend in varying directions and paths to move the bins 134 to and from varying arrangements of receptacles 112 at different locations in the inventory storage 110. Furthermore, although the conveying device 136 shown in FIG. 5 includes a conveyor belt that moves the bins 134, it is understood that other devices and approaches may be employed to move the items i to a packing location. For example, the automated picking system 130 may include one or more computer-controlled/tracked carts that move to the receptacles 112 to retrieve the items i and then move to a packing location to deliver the items i.

Although each receptacle 112 shown in FIG. 5 has its own dispensing device 132, it is understood that more than one receptacle 112 may share a common dispensing device, i.e., any configuration of dispensing devices 132 may be employed for any number of receptacles 112. Moreover, different types of dispensing devices 132 are contemplated by the present disclosure. For instance, in alternative embodiments, a robotic device may be employed to remove an item i from a receptacle 112*i* and to lift the item i a bin 134$_i$. (An example of a robotic device is described further below with reference to FIG. 6).

V. Packing Process

Figure 6:
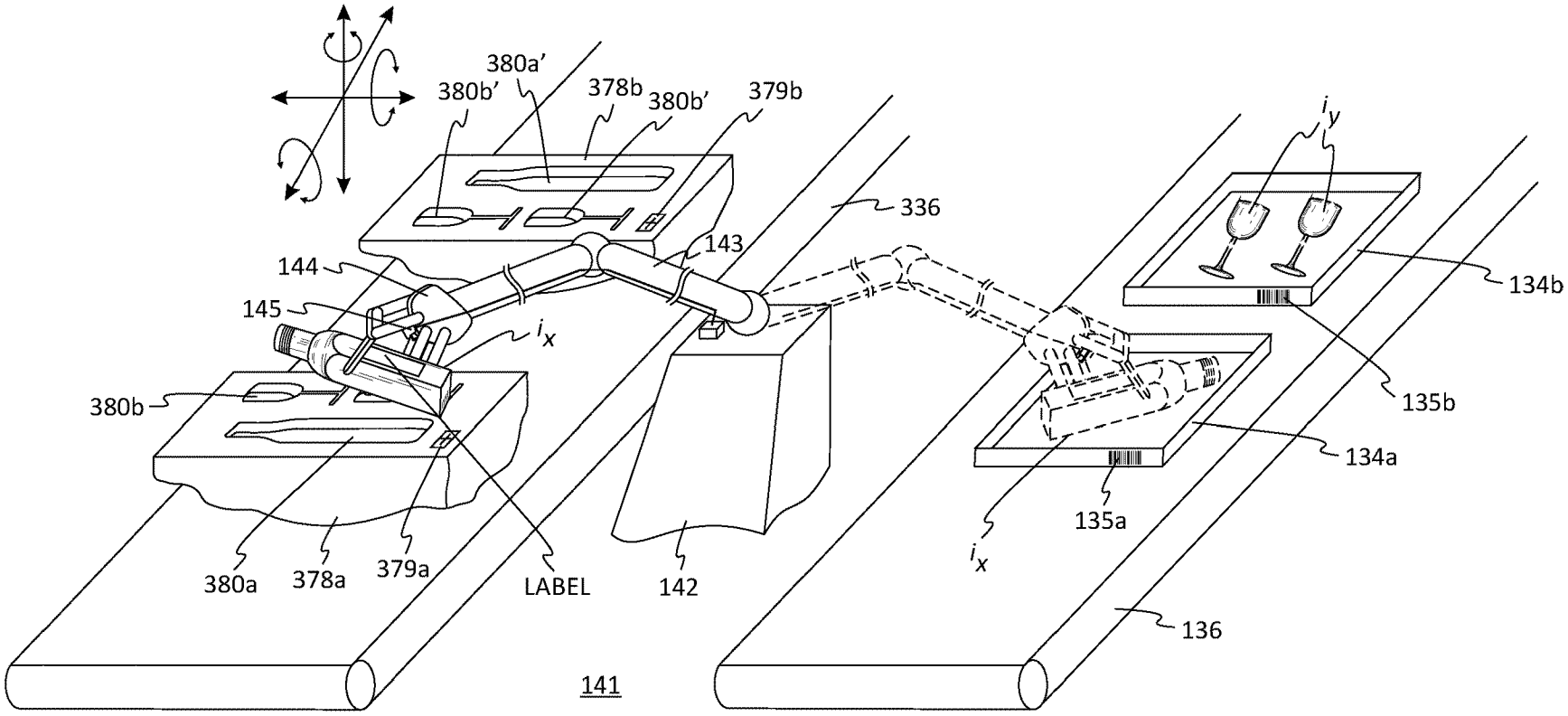
FIG. 6 illustrates an example system for packing items in an order, according to aspects of the present disclosure.

As described above, when the items i=1, 2, . . . , n have been retrieved and delivered to a designated packing location, the picking/packing controller 106 causes the automated packing system 140 to pack the items i in one or more containers 370. In particular, the automated packing system 140 packs the items i with one or more custom protective structures 378 according to the custom packaging specification 16. Referring to FIG. 6, an example implementation of the automated packing system 140 is illustrated.

As shown in FIG. 6, the automated picking system 130 delivers bins 134*a* and 134*b* to a packing location 141 via the conveying device 136. The bin 134*a* includes a quantity of an item $i_x$ (an olive oil bottle), and the bin 134*b* includes a quantity of an item $i_y$ (two glasses), where the items $i_x$ and $i_y$ correspond to items specified in an order 02.

As described above, the bins 134*a* and 134*b* include identifiers 135*a* and 135*b* that allow the automated picking system 130 to track the location of the bins 134*a* and 134*b* and the items $i_x$ and $i_y$, respectively. The identifiers 135*a* and 135*b* may include a barcode and/or other marking that can be read by image capture and/or scanning devices at various locations. Additionally or alternatively, the identifiers 135*a* and 135*b* may include a radio-frequency identification (RFID) or other signal-emitting device that can be tracked wirelessly. When the bins 134*a* and 134*b* arrive at the packing location 141, the identifiers 135*a* and 135*b* also allow the automatic packing system 140 to confirm that the items $i_x$ and $i_y$ specified in the order 02 have been delivered to the packing location 141.

As shown in FIG. 6, the automatic packing system 140 may include a robotic device 142 that handles the packing of items $i_x$ and $i_y$ for the order 02. The robotic device 142 includes an arm 143 that extends outwardly. A grasping device 144 is disposed at the distal end of the arm 143 to handle the items i. An image capture/scanning device 145 (e.g., camera) is also disposed at the distal end of the arm 143. According to one aspect, the image capture/scanning device 145 can evaluate the identifier 135 on each bin 134 by reading a barcode and/or other marking. Additionally or alternatively, the automatic packing system 140 can use information from an RFID or other signal-emitting device to determine what bins 134 are located in the packing location 141. The data from the image capture/scanning device 145 may be communicated to the picking/packing controller 106 for processing.

Another conveying device 336 (e.g., a conveyor belt) delivers the protective structures 378*a* and 378*b* from the automated packaging manufacturing system 150 to the packing location 141. The automated packing system 140 packs the items $i_x$ and $i_y$ for shipment with the protective structures 378*a* and 378*b*. The protective structures 378*a* and 378*b* are manufactured to provide a more optimal packaging scheme as set forth by the custom packaging specification 16. In particular, the automated packaging system 150 manufactures the first protective structure 378*a* to define recesses 380*a* and 380*b*. Correspondingly, the automated packaging system 150 manufactures the second protective structure 378*b* to define recesses 380*a*' and 380*b*'. When the protective structures 378*a* and 378*b* are combined, the recesses 380*a* and 380*a*' define an internal cavity that receives the item $i_x$, and the recesses 380*b* and 380*b*' define two internal cavities that respectively receive the items $i_y$. With the items $i_x$ and $i_y$ in these internal cavities, the $i_x$ and $i_y$ are protected during shipment. The protective structures 378*a* and 378*b* are formed from one or more materials to absorb forces that may damage the items $i_x$ and $i_y$ during shipment. Additionally, the internal cavities determine how the items $i_x$ and $i_y$ are positioned relative to each other and within a container (as described above) to provide enhanced protection during shipment.

To confirm that the protective structures 378*a* and 378*b* have been delivered to the packing location 141, the automatic packing system 140 can evaluate identifiers 379*a* and 379*b* provided on the protective structures 378*a* and 378*b*, respectively. Similar to the identifiers 135 on the bins 134, the identifiers 379*a* and 379*b* may include a barcode and/or other marking. In such a case, the image capture/scanning device 145 on the robotic device 142 may be employed to read the barcode and/or marking to identify the protective structures 378*a* and 378*b*. Additionally or alternatively, the identifiers 379*a* and 379*b* may include a radio-frequency identification (RFID) or other signal-emitting device that can be used to identify the protective structures 378*a* and 378*b* wirelessly.

When the automated packing system 140 determines that the desired items $i_x$ and $i_y$ and the corresponding protective structures 378*a* and 378*b* have been properly delivered to the packing location 141, the automated packing system 140 transfers the items $i_x$ and $i_y$ from the bins 134*a* and 134*b* to the recesses 380*a* and 380*b* of the protective structure 370*a*, respectively. As shown in FIG. 6, the grasping device 144 of the robotic device 142 can be employed to transfer the items $i_x$ and $i_y$. The automated packing system 140 refers to the custom packaging specification 16 to determine the how the items $i_x$ and $i_y$ should be positioned in the recesses 380*a* and 380*b*. In particular, the packaging optimization module 105 communicates the custom packaging specification 16 to the picking/packing controller 106 which in turn signals the automated packing system 140 how to pack the items $i_x$ and $i_y$.

The robotic device 142 can employ the image capture/scanning device 145 to capture one or more images of the bins 134*a* and 134*b*. The captured images are communicated to the picking/packing controller 106, which can then process the images to identify the bins 134*a* and 134*b* as well as the shape, position, and orientation of each item in the bins 134*a* and 134*b*. For example, the picking/packing controller 106 can employ object segmentation techniques to identify various shapes in the images and compare the shapes to stored information (e.g., stored images) describing the bins 134*a* and 134*b* as well as the items $i_x$ and $i_y$. Information on the shape of the items $i_x$ and $i_y$ may be stored in the item database 06. Accordingly, based on the images captured by the device 145, the robotic device 142 can properly orient itself relative to the bins 134*a* and 134*b* to grasp the items $i_x$ and $i_y$, respectively. Furthermore, using the captured images, the robotic device 142 can properly orient the grasping device 144 to handle and grasp the items $i_x$ and $i_y$ appropriately.

As shown in FIG. 6, the robotic device 142 can move the grasping device 144 according to six degrees of freedom. Therefore, the robotic device 142 can manipulate each item $i_x$ and $i_y$ so that they are handled with necessary care and properly positioned and oriented in the recesses 380*a* and 380*b* defined by the protective structures 378*a* and 378*b*. As FIG. 6 illustrates, the grasping device 142 first transfers the item $i_x$ (the olive oil bottle). Using the captured image(s) of the bin 134*a*, the grasping device 144 can be controlled to handle the olive oil bottle more stably at the body rather than, for example, the neck. In addition, the captured images can be employed to identify the label on the olive oil bottle, and the grasping device 144 can be controlled to turn the olive oil bottle so that the label will be properly oriented when it is eventually positioned in the recess 380*a*. Once the grasping device 144 grasps the item $i_x$ at the bin 134*a*, the robotic device 142 carries the item $i_x$ to the protective structures 378*a* and 378*b*.

Using the custom packaging specification 16, the automatic packing system 140 can determine that the first protective structure 378*a* is configured to protect the items $i_x$ and $i_y$ from the bottom and the second protective structure 378*b* is configured to protect the items $i_x$ and $i_y$ from the top. As such, the robotic device 142 first positions the items $i_x$ and $i_y$ in the first protective structure 378*a* and then subsequently places the second protective structure 378*b* over the items $i_x$ and $i_y$.

The robotic device 142 can also employ the image capture/scanning device 145 to capture one or more images of the first protective structure 378*a*. Based on the information in the captured images, the robotic device 142 can orient itself relative to the first protective structure 378*a*. In addition, using the captured images, the robotic device 142 can properly orient the grasping device 144 to position the items $i_x$ and $i_y$ properly relative to the recesses 380*a* and 380*b*, respectively. For example, the captured images are communicated to the picking/packing controller 106, which can then process the images to identify the first protective device 378*a* as well as the shape, position, and orientation of each recess 380*a* and 380*b*. In some cases, the picking/packing controller 106 can employ object segmentation techniques to identify the shapes in the images based on the design of the first protective device 378*a* provided by the custom packaging specification 16.

Additionally or alternatively, markings may be provided directly on the protective devices 378*a* that can be identified in images captured by the image capture/scanning device 145. These markings allow the picking/packing controller 106 to determine the orientation of the first protective device 378*a* and identify the recesses 380*a* and 380*b*. For instance, as shown in FIG. 6, the identifier 379*a* includes cross hairs that indicate how the first protective device 378*a* is positioned and oriented relative to the robotic device 142. In addition, respective markings may be placed in or near each recess 380*a* and 380*b* to indicate what items should be placed in each recess 380*a* and 380*b*.

Knowing where the recess 380*a* is positioned and oriented relative to the robotic device 142, the grasping device 144 can be controlled to manipulate the olive oil bottle according to one or more six degrees of freedom to position and orient the olive oil bottle relative to the recess 380*a* and to place the olive oil bottle in the recess 380*a*. As illustrated in FIG. 6, the bottle has been manipulated to ensure that when the olive oil bottle is placed in the recess 380*a*, the label faces upwardly from the recess 380*a*. Thus, when the packaging is opened by the recipient, the label is displayed to the recipient from the recess 380*a* in an aesthetically pleasing way. If necessary, the grasping device 144 can be further controlled to turn the olive oil bottle after the olive oil bottle has been placed in the recess 380*a* and ensure that the label is properly displayed.

After the olive oil bottle is transferred to the recess 380*a*, the robotic device 142 moves the grasping device 144 to the bin 134*b* to transfer the items $i_y$ (the glasses) to the recesses 380*b* in the protective structure 378*a*. Using captured image(s) of the bin 134*b*, the position and orientation of each glass can be determined. As such, the grasping device 144 can be controlled to handle each glass more stably at the bowl rather than, for example, the stem or foot. Once the grasping device 144 grasps the first of the glasses at the bin 134*b*, the robotic device 142 carries the first glass to the protective structure 378*a*. Using captured image(s) of the first protective device 378*a*, the position and orientation of each recess 380*b* can be determined. Knowing where the recess 380*b* is positioned and oriented relative to the robotic device 142, the grasping device 144 can be controlled to manipulate the first glass according to one or more six degrees of freedom to position and orient the glass relative to one of the recesses 380*b* and to place the glass in the first recess 380*b*. After the first glass is transferred to the first recess 380*b*, the robotic device 142 similarly transfers the second of the glasses to the second of the recesses 380*b* in the protective structure 378*a*.

Once the items $i_x$ and $i_y$ have been transferred to the first protective structure 380*a*, the robotic device 142 can place the second protective structure 378*b* over the first protective 378*a*. Using captured image(s) of the second protective device 378*b*, the recesses 380*a*' and 380*b*' can be identified and their position and orientation relative to the robotic device 142 can be determined. The picking/packing controller 106 can process these captured images in a manner similar to the images captured for the first protective structure 378*a*. Knowing where the recesses 380*a* and 380*b* of the first protective structure 378*b* are also positioned and oriented relative robotic device, the grasping device 144 can manipulate the second protective structure 378*b* so that the recesses 380*a*' and 380*b*' of the second protective structure 378*b* face downwardly and align with the recesses 380*a* and 380*b* of the first protective device 378*a*. As such, the recesses 380*a*' and 380*b*' can be placed over the items $i_x$ and $i_y$ disposed in the recesses 380*a* and 380*b*, respectively. When the first protective structure 378*a* and the second protective structure 378*b* are combined in this way, the recesses 380*a* and 380*a*' together define an internal cavity for the item $i_x$ and the recesses 380*b* and 380*b*' together define internal cavities for the items $i_y$. If required, the protective structures 378*a* and 378*b* can be secured together according to any appropriate technique, including, but not limited to, the use of tape, adhesive, string, mechanical/frictional engagement, shrink/stretch wrap, etc. In some embodiments, structural features of the protective structures 378*a* and 378*b* allow the robotic device 142 to grasp or otherwise manipulate the protective structures 378*a* and 378*b* more easily.

As illustrated in FIG. 6, the robotic device 142 can place the items $i_x$ and $i_y$ in the respective recesses 380*a* and 380*b* of the first protective structure 378*a* as a first step. The robotic device 143 can place the second protective structure 378*b* over the first protective structure 378*a* as a second step. Then, the robotic device 142 can place the combined protective structures 378*a* and 378*b* into a container 370, e.g., box, crate, etc., which has also been delivered to the packing location 141.

Figure 7:
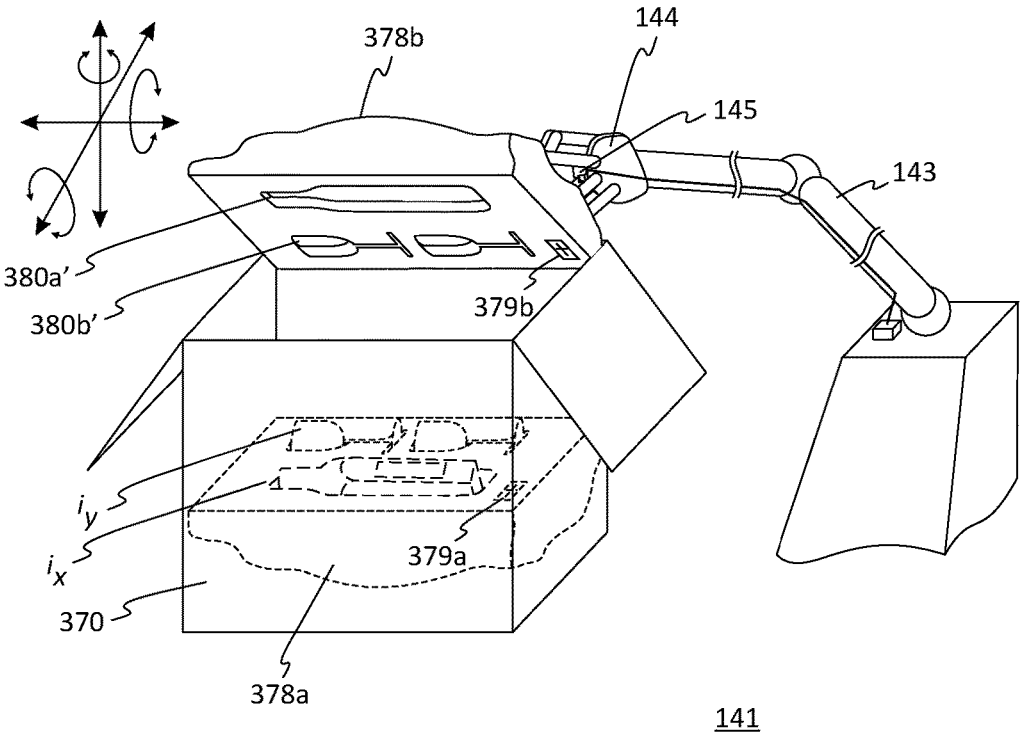
FIG. 7 illustrates further an example system for packing items in an order, according to aspects of the present disclosure.

Alternatively, as shown in FIG. 7, the robotic device 142 can place the first protective structure 378*a* with the items $i_x$ and $i_y$ in the container 370, before placing the second protective structure 378*b* over the first protective structure 378*a*. Or as a further alternative, the robotic device 142 can place the first protective structure 378*a* into the container 370, before placing the items $i_x$ and $i_y$ in the respective recesses 380*a* and 380*b*. The relative layered arrangement of the protective structure 378*a* and 378*b* allows the first protective structure 378*a*, the second protective structure 378*b*, and the items $i_x$ and $i_y$ to be easily placed into the container 370 in any one of many different sequences. In general, items i can be combined with the protective structures 378 and a container 370 in any order of steps.

Accordingly, the automated packing system 140 according to the present disclosure can use information from captured images to determine shape, position, and/or orientation of aspects of the bins 134, the items i, and the protective structures 378. Using shape, position, and/or orientation information, the automated packing system 140 can manipulate the items i according to one or more degrees of freedom to place them into recesses 380 of the protective structures 378 according to the custom packaging specification 16. As a result, the automated packing system 140 can position the items i relative to each other and the container 370 to achieve a more optimal arrangement in the three-dimensional space of the container 370.

The embodiments described herein may employ computing systems for processing information and controlling aspects of an order system 100. For example, in the computing system 101 shown in FIG. 1, the order processing module 103, the inventory module 104, the packaging optimization module 105, and the shipping module 108 process information relating to an order 02. Meanwhile, the picking/packing controller 106 controls the automated picking system 130, and the packaging manufacturing controller 107 controls the automated packaging manufacturing system 150. Generally, the computing system systems include one or more processors. For example, the computing system 101 include one or more shared or dedicated processors to provide the modules 102, 103, 104, and 107 and the controllers 105 and 106.

The processor(s) of a computing system may be implemented as a combination of hardware and software elements. The hardware elements may include combinations of operatively coupled hardware components, including microprocessors, communication/networking interfaces, memory, signal filters, circuitry, etc. The processors may be configured to perform operations specified by the software elements, e.g., computer-executable code stored on computer readable medium. The processors may be implemented in any device, system, or subsystem to provide functionality and operation according to the present disclosure. The processors may be implemented in any number of physical devices/machines. For example, the computing system 101 may include one or more shared or dedicated general purpose computer systems/servers to provide the modules 102, 103, 104, and 107 and the controllers 105 and 106. Indeed, parts of the processing of the example embodiments can be distributed over any combination of processors for better performance, reliability, cost, etc.

The physical devices/machines can be implemented by the preparation of integrated circuits or by interconnecting an appropriate network of conventional component circuits, as is appreciated by those skilled in the electrical art(s). The physical devices/machines, for example, may include field programmable gate arrays (FPGA's), application-specific integrated circuits (ASIC's), digital signal processors (DSP's), etc. The physical devices/machines may reside on a wired or wireless network, e.g., LAN, WAN, Internet, cloud, near-field communications, etc., to communicate with each other and/or other systems, e.g., Internet/web resources.

Appropriate software can be readily prepared by programmers of ordinary skill based on the teachings of the example embodiments, as is appreciated by those skilled in the software arts. Thus, the example embodiments are not limited to any specific combination of hardware circuitry and/or software. Stored on one computer readable medium or a combination of computer readable media, the computing systems may include software for controlling the devices and subsystems of the example embodiments, for driving the devices and subsystems of the example embodiments, for enabling the devices and subsystems of the example embodiments to interact with a human user (user interfaces, displays, controls), etc. Such software can include, but is not limited to, device drivers, operating systems, development tools, applications software, etc. A computer readable medium further can include the computer program product(s) for performing all or a portion of the processing performed by the example embodiments. Computer program products employed by the example embodiments can include any suitable interpretable or executable code mechanism, including but not limited to complete executable programs, interpretable programs, scripts, dynamic link libraries (DLLs), applets, etc. The processors may include, or be otherwise combined with, computer-readable media. Some forms of computer-readable media may include, for example, a hard disk, any other suitable magnetic medium, CD-ROM, CDRW, DVD, any other suitable optical medium, RAM, PROM, EPROM, FLASH-EPROM, any other suitable memory chip or cartridge, a carrier wave, or any other suitable medium from which a computer can read.

The computing systems may also include databases for storing data. For example, the computing system 101 includes an order database 03 for storing order information and an item database 06 for storing information on items for orders 02. Such databases may be stored on the computer readable media described above and may organize the data according to any appropriate approach. For examples, the data may be stored in relational databases, navigational databases, flat files, lookup tables, etc. Furthermore, the databases may be managed according to any type of database management software.

Although the system 100 determines custom packaging specifications 16 based on the characteristic data 14 of specific items i in an order 02, the determined custom packaging specifications 16 can be stored in a database (e.g., the order database 03) for retrieval when subsequent orders 02 are received for the same specific items i, according to some embodiments of the present disclosure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A computer-implemented method comprising:

generating, based at least on one or more characteristics of one or more items that are to be packaged, multiple, different, candidate packaging specifications that each specify:

(i) one or more characteristics of a container into which the one or more items are to be packaged, (ii) one or more characteristics relating to an arrangement of the one or more items within the container, and (iii) one or more characteristics of a custom protective structure for protectively retaining the one or more items in the container according to the arrangement;

selecting, based on selection criteria that include aesthetic criteria that evaluates an extent to which the one or more items, as positioned or distributed in the container, are consistent with a brand aesthetic, if packaged according to the candidate packaging specification, a particular candidate packaging specification from among the multiple, different, candidate packaging specifications that each specify:

(i) the one or more characteristics of the container into which the one or more items are to be packaged, (ii) the one or more characteristics relating to the arrangement of the one or more items within the container, and (iii) the one or more characteristics of the custom protective structure for protectively retaining the one or more items in the container according to the arrangement; and instructing an automated packaging manufacturing system to manufacture the custom protective structure that is specified by the selected, particular candidate packaging specification.

2. The method of claim 1, wherein, for each of the multiple, one or more of the multiple, different, candidate packaging specifications, one or more of the selection criteria evaluates an amount of material used by the protective structure.

3. The method of claim 1, wherein, for each of the multiple, one or more of the multiple, different, candidate packaging specifications, one or more of the selection criteria evaluates a cost of manufacturing the protective structure.

4. The method of claim 1, wherein, for each of the multiple, one or more of the multiple, different, candidate packaging specifications, one or more of the selection criteria evaluates a volume of the container.

5. The method of claim 1, wherein, for each of the multiple, one or more of the multiple, different, candidate packaging specifications, one or more of the selection criteria evaluates an amount of space within the container that is used by the one or more items if packaged according to the candidate packaging specification.

6. The method of claim 1, wherein, for each of the multiple, one or more of the multiple, different, candidate packaging specifications, one or more of the selection criteria evaluates a center of gravity or a center of mass of the container if packaged according to the candidate packaging specification.

7. The method of claim 1, wherein, for each of the multiple, one or more of the multiple, different, candidate packaging specifications, one or more of the selection criteria evaluates a likely amount of protection for the one or more items if packaged according to the candidate packaging specification.

8. The method of claim 1, wherein, for each of the multiple, one or more of the multiple, different, candidate packaging specifications, one or more of the selection criteria evaluates a likely ease of removal of the one or more items from the container if packaged according to the candidate packaging specification.

9. The method of claim 1, wherein the aesthetic criteria evaluates an extent to which one or more particular portions of the one or more items, or one or more particular portions of the custom protective structure, are immediately visible when the container or custom protective structure is first opened, if packaged according to the candidate packaging specification.

10. The method of claim 1, wherein, for each of the multiple, one or more of the multiple, different, candidate packaging specifications, one or more of the selection criteria evaluates a likely amount of damage associated with the one or more items if packaged according to the candidate packaging specification.

11. The method of claim 1, comprising packaging the one or more items in the custom protective structure, then packaging the custom protective structure into the container, using an articulated robot arm.

12. The method of claim 1, wherein the automated packaging manufacturing system manufactures the custom protective structure after the particular candidate packaging specification is selected.

13. A non-transitory computer readable storage medium encoded with a computer program, the program comprising instructions that when executed by data processing apparatus cause the data processing apparatus to perform operations comprising:

generating, based at least on one or more characteristics of one or more items that are to be packaged, multiple, different, candidate packaging specifications that each specify:

(i) one or more characteristics of a container into which the one or more items are to be packaged, (ii) one or more characteristics relating to an arrangement of the one or more items within the container, and (iii) one or more characteristics of a custom protective structure for protectively retaining the one or more items in the container according to the arrangement;

selecting, based on selection criteria that include ease-of-removal criteria that evaluates whether a position or distribution of the one or more items in the container facilitates easy removal of the items by a recipient of the container, if packaged according to the candidate packaging specification, a particular candidate packaging specification from among the multiple, different, candidate packaging specifications that each specify:

(i) the one or more characteristics of the container into which the one or more items are to be packaged, (ii) the one or more characteristics relating to the arrangement of the one or more items within the container, and (iii) the one or more characteristics of the custom protective structure for protectively retaining the one or more items in the container according to the arrangement; and instructing an automated packaging manufacturing system to manufacture the custom protective structure that is specified by the selected, particular candidate packaging specification.

14. The medium of claim 13, wherein, for each of the multiple, one or more of the multiple, different, candidate packaging specifications, one or more of the selection criteria evaluates an amount of material used by the protective structure.

15. The medium of claim 13, wherein, for each of the multiple, one or more of the multiple, different, candidate packaging specifications, one or more of the selection criteria evaluates a cost of manufacturing the protective structure.

16. The medium of claim 13, wherein, for each of the multiple, one or more of the multiple, different, candidate packaging specifications, one or more of the selection criteria evaluates a volume of the container.

17. The medium of claim 13, wherein, for each of the multiple, one or more of the multiple, different, candidate packaging specifications, one or more of the selection criteria evaluates an amount of space within the container that is used by the one or more items if packaged according to the candidate packaging specification.

18. The medium of claim 13, wherein, for each of the multiple, one or more of the multiple, different, candidate packaging specifications, one or more of the selection criteria evaluates a center of gravity or a center of mass of the container if packaged according to the candidate packaging specification.

19. The medium of claim 13, wherein, for each of the multiple, one or more of the multiple, different, candidate packaging specifications, one or more of the selection criteria evaluates a likely amount of protection for the one or more items if packaged according to the candidate packaging specification.

20. A system comprising:

one or more computers and one or more storage devices storing instructions that are operable, when executed by the one or more computers, to cause the one or more computers to perform operations comprising:

generating, based at least on one or more characteristics of one or more items that are to be packaged, multiple, different, candidate packaging specifications that each specify:

(i) one or more characteristics of a container into which the one or more items are to be packaged, (ii) one or more characteristics relating to an arrangement of the one or more items within the container, and (iii) one or more characteristics of a custom protective structure for protectively retaining the one or more items in the container according to the arrangement;

selecting, based on selection criteria that include protection criteria that evaluates feedback received from past recipients of similar items that indicates whether, if packaged similar to the candidate packaging specification, the similar items were damaged during shipment, a particular candidate packaging specification from among the multiple, different, candidate packaging specifications that each specify:

(i) the one or more characteristics of the container into which the one or more items are to be packaged, (ii) the one or more characteristics relating to the arrangement of the one or more items within the container, and (iii) the one or more characteristics of the custom protective structure for protectively retaining the one or more items in the container according to the arrangement; and instructing an automated packaging manufacturing system to manufacture the custom protective structure that is specified by the selected, particular candidate packaging specification.

* * * * *